US011320756B2

(12) United States Patent
Kototani et al.

(10) Patent No.: US 11,320,756 B2
(45) Date of Patent: May 3, 2022

(54) ELECTROPHOTOGRAPHIC APPARATUS, PROCESS CARTRIDGE, AND CARTRIDGE SET

(71) Applicant: CANON KABUSHIKI KAISHA, Tokyo (JP)

(72) Inventors: Shohei Kototani, Shizuoka (JP); Noriyoshi Umeda, Shizuoka (JP); Tsuneyoshi Tominaga, Shizuoka (JP); Shohei Tsuda, Shizuoka (JP); Noboru Miyagawa, Shizuoka (JP); Kazuhiro Yamauchi, Shizuoka (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 5 days.

(21) Appl. No.: 17/071,109

(22) Filed: Oct. 15, 2020

(65) Prior Publication Data

US 2021/0116832 A1 Apr. 22, 2021

(30) Foreign Application Priority Data

Oct. 18, 2019 (JP) ..... JP2019-191586

(51) Int. Cl.
*G03G 9/097* (2006.01)
*G03G 9/087* (2006.01)
(Continued)

(52) U.S. Cl.
CPC ..... *G03G 9/09775* (2013.01); *G03G 9/0819* (2013.01); *G03G 9/0827* (2013.01);
(Continued)

(58) Field of Classification Search
CPC ..... G03G 9/09775; G03G 9/0819; G03G 9/0827; G03G 9/08711; G03G 15/0233; G03G 15/75; G03G 21/1814
See application file for complete search history.

(56) References Cited

U.S. PATENT DOCUMENTS 6,697,587 B2 * 2/2004 Harada ..... C08K 3/04 252/511
6,864,030 B2 3/2005 Shirai et al.
(Continued)

FOREIGN PATENT DOCUMENTS

JP 2002003651 A 1/2002
JP 2003107781 A 4/2003
(Continued)

OTHER PUBLICATIONS

U.S. Appl. No. 17/065,258, Kohei Makisumi, filed Oct. 7, 2020.
(Continued)

*Primary Examiner* — Ryan D Walsh
(74) *Attorney, Agent, or Firm* — Venable LLP

(57) ABSTRACT

An electrophotographic apparatus comprising an electrophotographic photosensitive member, a charging unit, and a developing unit, wherein the charging unit has a conductive member contactable with the electrophotographic photosensitive member, and a conductive layer of the conductive member has a matrix-domain structure; at least some of the domains are exposed at the outer surface; a volume resistivity R1 of the matrix and a volume resistivity R2 of the domains satisfy specific relationship; Martens hardness G1 of the matrix and Martens hardness G2 of the domains satisfy relationship G1<G2; the surface roughness Ra of the conductive member is not more than 2.00 μm; the toner has an external additive having a shape factor SF-1 of not more than 115; and A<Dms is satisfied where A is the number-average diameter of the external additive and Dms is a distance between adjacent walls between the domains.

10 Claims, 6 Drawing Sheets

(51) Int. Cl.

| | |
|---|---|
| ***G03G 21/18*** | (2006.01) |
| ***G03G 9/08*** | (2006.01) |
| ***G03G 15/00*** | (2006.01) |
| ***G03G 15/02*** | (2006.01) |

(52) U.S. Cl.
CPC ..... *G03G 9/08711* (2013.01); *G03G 15/0233* (2013.01); *G03G 15/75* (2013.01); *G03G 21/1814* (2013.01)

(56) References Cited

U.S. PATENT DOCUMENTS

| | | | |
|---|---|---|---|
| 8,298,670 | B2 | 10/2012 | Muranaka et al. |
| 8,449,975 | B2 | 5/2013 | Hirakoso et al. |
| 8,628,854 | B2 | 1/2014 | Yamauchi et al. |
| 8,668,987 | B2 | 3/2014 | Yamauchi et al. |
| 8,715,830 | B2 | 5/2014 | Yamada et al. |
| 8,771,818 | B2 | 7/2014 | Nishioka et al. |
| 8,852,743 | B2 | 10/2014 | Kikuchi et al. |
| 9,023,465 | B2 | 5/2015 | Yamada et al. |
| 9,086,643 | B2 | 7/2015 | Kikuchi et al. |
| 9,098,006 | B2 | 8/2015 | Uematsu et al. |
| 9,128,403 | B2 | 9/2015 | Yamauchi et al. |
| 9,146,482 | B2 | 9/2015 | Watanabe et al. |
| 9,158,213 | B2 | 10/2015 | Taniguchi et al. |
| 9,274,442 | B2 | 3/2016 | Sato et al. |
| 9,274,496 | B2 | 3/2016 | Miyagawa et al. |
| 9,360,789 | B1 | 6/2016 | Masu et al. |
| 9,442,408 | B2 | 9/2016 | Yamauchi et al. |
| 9,442,451 | B2 | 9/2016 | Yamauchi et al. |
| 9,541,854 | B2 | 1/2017 | Kikuchi et al. |
| 9,547,250 | B2 | 1/2017 | Kikuchi et al. |
| 9,551,947 | B2 | 1/2017 | Hiroko et al. |
| 9,551,949 | B2 | 1/2017 | Yamauchi et al. |
| 9,581,931 | B2 | 2/2017 | Yamada et al. |
| 9,599,913 | B2 | 3/2017 | Nishioka et al. |
| 9,599,914 | B2 | 3/2017 | Uematsu et al. |
| 9,632,446 | B2 | 4/2017 | Matsuda et al. |
| 9,639,009 | B2 | 5/2017 | Yamaguchi et al. |
| 9,651,888 | B2 | 5/2017 | Muranaka et al. |
| 9,665,028 | B2 | 5/2017 | Arimura et al. |
| 9,665,029 | B2 | 5/2017 | Hino et al. |
| 9,740,133 | B2 | 8/2017 | Yamauchi et al. |
| 9,811,009 | B2 | 11/2017 | Yamada et al. |
| 9,811,021 | B2 | 11/2017 | Muranaka et al. |
| 9,897,931 | B2 | 2/2018 | Nishioka et al. |
| 9,958,802 | B2 | 5/2018 | Kikuchi et al. |
| 9,964,874 | B2 | 5/2018 | Suzumura et al. |
| 9,964,881 | B2 | 5/2018 | Ikejiri et al. |
| 9,964,914 | B2 | 5/2018 | Arimura et al. |
| 9,977,353 | B2 | 5/2018 | Nishioka et al. |
| 10,018,927 | B2 | 7/2018 | Yamada et al. |
| 10,018,934 | B2 | 7/2018 | Yamada et al. |
| 10,025,216 | B2 | 7/2018 | Uematsu et al. |
| 10,108,129 | B2 | 10/2018 | Yamaguchi et al. |
| 10,280,148 | B2 | 5/2019 | Nishioka et al. |
| 10,416,588 | B2 | 9/2019 | Masu et al. |
| 10,488,777 | B2 | 11/2019 | Terauchi et al. |
| 10,585,370 | B2 | 3/2020 | Miyagawa et al. |
| 10,649,350 | B2 | 5/2020 | Yamaguchi et al. |
| 10,678,154 | B2 | 6/2020 | Takashima et al. |
| 10,678,158 | B2 | 6/2020 | Kikuchi et al. |
| 11,061,342 | B2 * | 7/2021 | Umeda ..... G03G 5/0553 |
| 11,112,719 | B2 * | 9/2021 | Makisumi ..... G03G 21/1814 |
| 11,137,716 | B2 * | 10/2021 | Hiyama ..... G03G 5/00 |
| 2012/0251171 | A1 | 10/2012 | Muranaka et al. |
| 2012/0308261 | A1 | 12/2012 | Tsuru et al. |
| 2013/0223886 | A1 | 8/2013 | Miyagawa et al. |
| 2013/0236214 | A1 | 9/2013 | Koide et al. |
| 2013/0251403 | A1 | 9/2013 | Matsuda et al. |
| 2013/0281276 | A1 | 10/2013 | Watanabe et al. |
| 2014/0255838 | A1 * | 9/2014 | Matsuda ..... G03G 5/14708 430/56 |
| 2015/0331346 | A1 | 11/2015 | Yamauchi et al. |
| 2018/0217551 | A1 | 8/2018 | Arimura et al. |
| 2020/0150552 | A1 * | 5/2020 | Shindo ..... G03G 15/1685 |
| 2020/0225593 | A1 | 7/2020 | Yamaguchi et al. |
| 2020/0310264 | A1 | 10/2020 | Kurachi et al. |
| 2020/0310265 | A1 | 10/2020 | Nishioka et al. |
| 2020/0310266 | A1 | 10/2020 | Kikuchi et al. |
| 2020/0392306 | A1 * | 12/2020 | Lee ..... C09D 7/61 |
| 2021/0026295 | A1 | 1/2021 | Yamada et al. |
| 2021/0033996 | A1 | 2/2021 | Kikuchi et al. |
| 2021/0041796 | A1 | 2/2021 | Nishioka et al. |
| 2021/0116826 | A1 * | 4/2021 | Nishida ..... G03G 21/1814 |
| 2021/0116827 | A1 * | 4/2021 | Fukudome ..... G03G 9/0823 |
| 2021/0116829 | A1 * | 4/2021 | Tomono ..... C08K 3/04 |
| 2021/0116831 | A1 * | 4/2021 | Tominaga ..... G03G 9/09716 |
| 2021/0116832 | A1 * | 4/2021 | Kototani ..... G03G 9/08711 |
| 2021/0116833 | A1 * | 4/2021 | Ishiduka ..... G03G 15/0233 |
| 2021/0116856 | A1 * | 4/2021 | Mukai ..... G03G 9/0825 |
| 2021/0116858 | A1 * | 4/2021 | Watariguchi ..... G03G 5/0553 |
| 2021/0116859 | A1 * | 4/2021 | Unno ..... G03G 15/0233 |
| 2021/0116860 | A1 * | 4/2021 | Suzumura ..... C08K 3/26 |

FOREIGN PATENT DOCUMENTS

| | | | |
|---|---|---|---|
| JP | 2003280246 | A | 10/2003 |
| JP | 2005049630 | A | 2/2005 |
| JP | 2012068623 | A | 4/2012 |
| JP | 2017107169 | A | 6/2017 |
| JP | 2017207680 | A | 11/2017 |
| JP | 2017211648 | A | 11/2017 |
| JP | 2018077385 | A | 5/2018 |
| JP | 2019045578 | A | 3/2019 |

OTHER PUBLICATIONS

U.S. Appl. No. 17/069,919, Tsutomu Nishida, filed Oct. 14, 2020.
U.S. Appl. No. 17/070,054, Yuka Ishiduka, filed Oct. 14, 2020.
U.S. Appl. No. 17/070,085, Fumiyuki Hiyama, filed Oct. 14, 2020.
U.S. Appl. No. 17/070,179, Kaname Watariguchi, filed Oct. 14, 2020.
U.S. Appl. No. 17/071,103, Noriyoshi Umeda, filed Oct. 15, 2020.
U.S. Appl. No. 17/071,227, Kosuke Fukudome, filed Oct. 15, 2020.
U.S. Appl. No. 17/071,246, Tomohiro Unno, filed Oct. 15, 2020.
U.S. Appl. No. 17/071,283, Yoshitaka Suzumura, filed Oct. 15, 2020.
U.S. Appl. No. 17/071,535, Hiroyuki Tomono, filed Oct. 15, 2020.
U.S. Appl. No. 17/071,540, Tsuneyoshi Tominaga, filed Oct. 15, 2020.

* cited by examiner

ELECTROPHOTOGRAPHIC APPARATUS, PROCESS CARTRIDGE, AND CARTRIDGE SET

BACKGROUND OF THE INVENTION

Field of the Invention

The present disclosure is directed to an electrophotographic apparatus, a process cartridge, and a cartridge set.

Description of the Related Art

Methods of visualizing image information via an electrostatic latent image, e.g., electrophotography, are used in copiers, multifunction machines, and printers, and, in recent years, demands for further increases in speed and image quality are on the rise.

A conductive member is used as the charging member in electrophotographic apparatuses. A structure having a conductive support and a conductive layer disposed on the support is known for the conductive member. The conductive member functions to transport charge from the conductive support to the surface of the conductive member and to impart charge to an abutting object through electrical discharge or triboelectric charging.

In its role as a charging member, the conductive member is a member that causes the generation of an electrical discharge with the electrophotographic photosensitive member and charges the surface of the electrophotographic photosensitive member.

For example, Japanese Patent Application Laid-open No. 2002-3651 describes a charging member that has a uniform electrical resistance and that exhibits stable electrical characteristics over time without being influenced by changes in the environment, e.g., temperature, humidity, and so forth.

Japanese Patent Application Laid-open No. 2018-77385 discloses efforts to provide a high-quality image by controlling characteristics of surface contamination of the charging member through controlling the unevenness in the surface of the charging member to a desired shape and through selecting an amount of external additive contained in the toner.

SUMMARY OF THE INVENTION

However, it has been found with regard to the inventions described in these documents that there is room for further investigations into image-forming processes of recent years where high speeds and high image qualities are required. For example, the very small amount of external additive that has passed the cleaning blade causes, due to an increased speed, a decline in the charging ability of the charging member to charge the electrophotographic photosensitive member, which may produce white spot-shaped image defects in parts of the image.

The present disclosure provides an electrophotographic apparatus, a process cartridge, and a cartridge set that are able to suppress the occurrence of image defects and provide high-quality images. Specifically, the present disclosure is directed to providing an electrophotographic apparatus, a process cartridge and a cartridge set that are able to suppress, in a low-temperature, low-humidity environment and even under conditions in which the process speed has been increased, the generation of image defects caused by an external additive that has slipped past the process of cleaning on an electrophotographic photosensitive member, and are thus able to provide high-quality images.

At least one embodiment of the present disclosure provides an electrophotographic apparatus comprising:

an electrophotographic photosensitive member, a charging unit for charging a surface of the electrophotographic photosensitive member, and a developing unit for developing an electrostatic latent image formed on the surface of the electrophotographic photosensitive member with a toner to form a toner image on the surface of the electrophotographic photosensitive member, wherein the charging unit comprises a conductive member disposed to be contactable with the electrophotographic photosensitive member;

the conductive member comprises:

a support having a conductive outer surface, and a conductive layer disposed on this outer surface of the support;

the conductive layer comprises:

a matrix, and a plurality of domains dispersed in the matrix;

the matrix contains a first rubber;

each of the domains contains a second rubber and an electronic conductive agent;

at least some of the domains are exposed at an outer surface of the conductive member;

the outer surface of the conductive member is constituted of at least the matrix and the domains that are exposed at the outer surface of the conductive member;

the matrix has a volume resistivity R1 of larger than $1.00\times10^{12}$ Ω·cm;

a volume resistivity R2 of the domains is smaller than the volume resistivity R1 of the matrix;

when G1 is Martens hardness in $N/mm^2$ measured on the matrix that is exposed at the outer surface of the conductive member and G2 is Martens hardness in $N/mm^2$ measured on the domains that are exposed at the outer surface of the conductive member, relationship $G1<G2$ is satisfied;

the outer surface of the conductive member has a surface roughness Ra of not more than 2.00 μm;

the developing unit comprises the toner;

the toner comprises:

a toner particle containing a binder resin, and an external additive externally added to the toner particle;

the external additive has primary particle having a shape factor SF-1 of not more than 115; and when A is a number-average diameter of the primary particles of the external additive and Dms is an arithmetic average value of a distance between adjacent walls between the domains in the conductive layer in observation of the outer surface of the conductive member, $A<Dms$ is satisfied.

Also, at least one embodiment of the present disclosure provides a process cartridge detachably provided to a main body of an electrophotographic apparatus, wherein the process cartridge comprises a charging unit for charging a surface of an electrophotographic photosensitive member, and a developing unit for developing an electrostatic latent image formed on the surface of the electrophotographic photosensitive member with a toner to form a toner image on the surface of the electrophotographic photosensitive member;

the charging unit comprises a conductive member disposed to be contactable with the electrophotographic photosensitive member;

the conductive member comprises:

a support having a conductive outer surface, and a conductive layer disposed on this outer surface of the support;

the conductive layer comprises:

a matrix, and a plurality of domains dispersed in the matrix;

the matrix contains a first rubber;

each of the domains contains a second rubber and an electronic conductive agent;

at least some of the domains are exposed at the outer surface of the conductive member;

the outer surface of the conductive member is constituted of at least the matrix and the domains that are exposed at the outer surface of the conductive member;

the matrix has a volume resistivity R1 of larger than $1.00\times10^{12}$ Ω·cm;

a volume resistivity R2 of the domains is smaller than the volume resistivity R1 of the matrix;

when G1 is Martens hardness in $N/mm^2$ measured on the matrix that is exposed at the outer surface of the conductive member and G2 is Martens hardness in $N/mm^2$ measured on the domains that are exposed at the outer surface of the conductive member, relationship G1<G2 is satisfied;

the outer surface of the conductive member has a surface roughness Ra of not more than 2.00 μm;

the developing unit comprises the toner;

the toner comprises:

a toner particle containing a binder resin, and an external additive externally added to the toner particle;

the external additive has primary particle having a shape factor SF-1 of not more than 115; and when A is a number-average diameter of the primary particles of the external additive and Dms is an arithmetic average value of a distance between adjacent walls between the domains in the conductive layer in observation of the outer surface of the conductive member, A<Dms is satisfied.

Also, at least one embodiment of the present disclosure provides a cartridge set comprising a first cartridge and a second cartridge detachably provided to a main body of an electrophotographic apparatus, wherein the first cartridge comprises a charging unit for charging a surface of an electrophotographic photosensitive member and has a first frame for supporting the charging unit;

the second cartridge comprises a toner container that holds a toner for forming a toner image on the surface of the electrophotographic photosensitive member by developing an electrostatic latent image formed on the surface of the electrophotographic photosensitive member;

the charging unit comprises a conductive member disposed to be contactable with the electrophotographic photosensitive member;

the conductive member comprises:

a support having a conductive outer surface, and a conductive layer disposed on this outer surface of the support;

the conductive layer comprises:

a matrix, and a plurality of domains dispersed in the matrix;

the matrix contains a first rubber;

each of the domains contains a second rubber and an electronic conductive agent;

at least some of the domains are exposed at the outer surface of the conductive member;

the outer surface of the conductive member is constituted of at least the matrix and the domains that are exposed at the outer surface of the conductive member;

the matrix has a volume resistivity R1 of larger than $1.00\times10^{12}$ Ω·cm;

a volume resistivity R2 of the domains is smaller than the volume resistivity R1 of the matrix;

when G1 is Martens hardness in $N/mm^2$ measured on the matrix that is exposed at the outer surface of the conductive member and G2 is Martens hardness in $N/mm^2$ measured on the domains that are exposed at the outer surface of the conductive member, relationship G1<G2 is satisfied;

the outer surface of the conductive member has a surface roughness Ra of not more than 2.00 μm;

the toner comprises:

a toner particle containing a binder resin, and an external additive externally added to the toner particle;

the external additive has primary particle having a shape factor SF-1 of not more than 115; and when A is a number-average diameter of the primary particles of the external additive and Dms is an arithmetic average value of a distance between adjacent walls between the domains in the conductive layer in observation of the outer surface of the conductive member, A<Dms is satisfied.

The present disclosure can provide an electrophotographic apparatus, a process cartridge and a cartridge set that are able to suppress, in a low-temperature, low-humidity environment and even under conditions in which the process speed has been increased, the generation of image defects caused by an external additive that has slipped past the process of cleaning on an electrophotographic photosensitive member, and are thus able to provide high-quality images.

Further features of the present invention will become apparent from the following description of exemplary embodiments with reference to the attached drawings.

DESCRIPTION OF THE EMBODIMENTS

Figure 1:
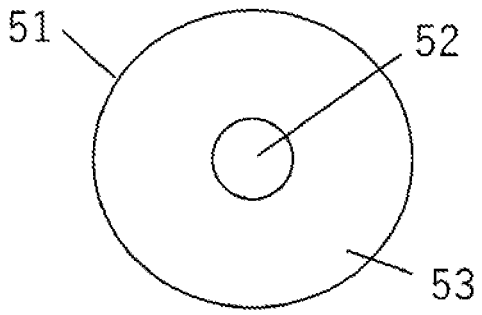
FIG. 1 is a cross-sectional diagram of a charging roller for the direction orthogonal to the longitudinal direction.

Unless specifically indicated otherwise, the expressions "from XX to YY" and "XX to YY" that show numerical value ranges refer to numerical value ranges that include the lower limit and upper limit that are the end points.

When numerical value ranges are provided in stages, the upper limits and lower limits of the individual numerical value ranges may be combined in any combination.

According to investigations by the present inventors, it was discovered that the combination of the herebelow-described toner and conductive member functioning as a charging member can suppress white spot image defects and provide high-quality electrophotographic images and can do so even in the low-temperature, low-humidity environments that facilitate a reduction in the cleaning performance by the cleaning member for the electrophotographic photosensitive member.

The Toner

The toner comprises a toner particle containing a binder resin, and comprises an external additive externally added to the toner particle, wherein a shape factor SF-1 of the primary particles of the external additive is not more than 115 and A<Dms is satisfied where A is the number-average primary particle diameter of the external additive and Dms is the arithmetic average value of the distance between adjacent walls between the domains in the conductive layer in observation of the outer surface of the conductive member.

The Conductive Member

The conductive member is disposed to be contactable with the electrophotographic photosensitive member and has a support having a conductive outer surface and has a conductive layer disposed on this outer surface of the support;

the conductive layer has a matrix and a plurality of domains dispersed in the matrix;

the matrix contains a first rubber;

each of the domains contains a second rubber and an electronic conductive agent;

at least a portion of the domains are exposed at the outer surface of the conductive member;

the outer surface of the conductive member is constituted of at least the matrix and the domains that are exposed at the outer surface of the conductive member;

the volume resistivity R1 of the matrix is greater than $1.00\times10^{12}$ Ω·cm;

the volume resistivity R2 of the domains is smaller than the volume resistivity R1 of the matrix;

defining G1 as the Martens hardness in $N/mm^2$ measured on the matrix that is exposed at the outer surface of the conductive member and defining G2 as the Martens hardness in $N/mm^2$ measured on the domains that are exposed at the outer surface of the conductive member, the relationship G1<G2 is satisfied; and the surface roughness Ra of the outer surface of the conductive member is not more than 2.00 μm.

The outer surface of the conductive member is the surface in contact with the toner at the conductive member.

Ina general electrophotographic process, the untransferred toner present on the surface of the photosensitive drum after the transfer process is collected in a cleaning step; however, the external additive, which has a small diameter of several tens to several hundreds of nanometers, can slip through since complete collection is not possible and thus can reach the charging process. It is hypothesized that when this occurs, an unintended very small discharge, due to the insertion of the external additive between the conductive member and the photosensitive drum, occurs in the charging process and the potential on the photosensitive drum surface becomes nonuniform and white spot image defects end up being produced.

The shape factor SF-1 of the primary particles of the external additive in the toner is not more than 115. When SF-1 satisfies this range, this means that the external additive is close to a true sphere and the external additive can then roll in the nip region between the conductive member and the photosensitive drum. It is thought that as a result the accumulation or retention of the external additive at the surface of the conductive member can be suppressed.

Moreover, when the conductive member described above is combined with a toner having such an external additive, the external additive that has undergone rolling in the conductive member/photosensitive drum nip region readily transfers, for the reasons given below, to the matrix at the surface of the conductive member. It is thought that contamination of the domains, which form the starting point for electrical discharge, can be inhibited as a consequence.

In addition, it is hypothesized that by having A<Dms be satisfied, where A is the number-average primary particle diameter of the external additive and Dms is the arithmetic average value of the distance between adjacent walls between the domains in the conductive layer in observation of the outer surface of the conductive member, interference with the electrical discharge from the domains does not occur even when the external additive attaches to the matrix of the conductive member.

The reasons why the conductive member described in the preceding can suppress white spot image defects are thought to be as follows.

When following a single point on the charging member surface with elapsed time during the electrophotographic process in which an electrical discharge is produced while the electrophotographic photosensitive member is being rotated, it has been found that, from the electrical discharge starting point to end point, a plurality of electrical discharges are repeatedly produced rather than an electrical discharge being continuously produced.

With the charging member according to Japanese Patent Application Laid-open No. 2002-3651, it is thought that conduction paths capable of transporting charge are formed reaching from the outer surface of the support to the outer surface of the conductive member. As a consequence, the majority of the charge accumulated in the conductive layer is emitted by a single electrical discharge toward the body being charged, e.g., the photosensitive member or toner.

Here, the present inventors carried out detailed measurement and analysis, using an oscilloscope, of the circumstances of electrical discharge by the charging member according to Japanese Patent Application Laid-open No. 2002-3651. As a result, with the charging member according to Japanese Patent Application Laid-open No. 2002-3651, it was recognized that, as the process speed becomes faster, a so-called electrical discharge omission is produced, in which electrical discharge does not occur in a timing where electrical discharge should properly occur. With regard to the reason for the occurrence of the electrical discharge omission, it is thought to be due to a failure to achieve, after the consumption of the majority of charge accumulated within the conductive layer by an electrical discharge from the conductive member, the accumulation of charge in the conductive layer for the next electric discharge.

In this regard, the present inventors examined the idea that the electrical discharge omission could be abolished if a large amount of charge could be accumulated in the conductive layer and the accumulated charge were not consumed all at once by one electrical discharge. As a result of additional extensive investigations based on this examination, the discovery was made that a conductive member provided with the constitution according to the present disclosure can respond well to these requirements.

The conductive member can accumulate satisfactory charge at the individual domains when a bias is applied with the photosensitive member. In addition, since the domains are divided from each other by the electrically insulating matrix, simultaneous charge transfer between domains can be inhibited. As a consequence of this, the discharge in a single electrical discharge of the majority of the charge accumulated within the conductive layer can be prevented.

As a result, a state can be set up within the conductive layer in which, even directly after the completion of a first electrical discharge, charge for the next electrical discharge is still accumulated. Due to this, a stable electrical discharge can be produced on a short cycle. Such an electrical discharge achieved by the conductive member according to the present disclosure is also referred to as a "microdischarge" in the following.

A conductive layer provided with a matrix-domain structure as described in the preceding can suppress the occurrence of simultaneous charge transfer between domains when a bias is applied and can bring about the accumulation of satisfactory charge within the domains. As a consequence, it is hypothesized that this conductive member, even when deployed under conditions where the occurrence of an unstable electrical discharge is facilitated, as in low-temperature, low-humidity environments, can continuously impart a very stable charge to the photosensitive drum and can suppress the occurrence of the previously described image defects.

In addition, the conductive member is constituted of two regions (the matrix and domains) that have different Martens hardnesses, and the Martens hardnesses G1 and G2, which are respectively measured on the matrix and the domains that constitute the outer surface of this conductive member, satisfy the relationship G1<G2.

With regard to the external additive that has come into contact with the outer surface of the conductive member, since the hardness of the domain areas is higher than that of the matrix area, it is thought that the external additive in the nip region preferentially rolls to between the matrix area and photosensitive drum and stabilizes there. It is hypothesized that this works against the presence of the external additive between the domains and the photosensitive drum in the nip region and that the previously described image defects then do not occur.

It is further hypothesized that the torque in this nip region is lowered due to the rolling of the external additive in the nip region, resulting in a lessening of the pressing force by the external additive into the photosensitive drum and thus also in an inhibition of the occurrence of drum scratching.

The surface roughness Ra of the outer surface of the conductive member must be not more than 2.00 μm. Having the surface roughness Ra be not more than 2.00 μm is hypothesized to enable the external additive to undergo favorable rolling in the nip region between the conductive member and the photosensitive drum. Moreover, since the external additive is unlikely to remain between the domain and photosensitive drum, it is hypothesized that the generation of image defects is then impeded and that the occurrence of scratching of the photosensitive drum is also inhibited.

Preferred conditions for the conductive member and toner according to the present disclosure will be described in sequence based on the mechanisms provided in the preceding.

The Conductive Member

A conductive member having a roller configuration (also referred to herebelow as a "conductive roller") will be described with reference to FIG. 1 as an example of the conductive member. FIG. 1 is a diagram of a cross section orthogonal to the direction along the axis of the conductive roller (also referred to herebelow as the "longitudinal direction"). The conductive roller 51 has a cylindrical conductive support 52 and has a conductive layer 53 formed on the circumference of the support 52, i.e., on the outer surface of the support.

The Support

The material constituting the support can be a suitable selection from materials known in the field of conductive members for electrophotographic applications and materials that can be utilized as a conductive member. Examples here are metals and alloys such as aluminum, stainless steel, conductive synthetic resins, iron, copper alloys, and so forth.

An oxidation treatment or a plating treatment, e.g., with chromium, nickel, and so forth, may be executed on the preceding. Electroplating or electroless plating may be used as the plating mode. Electroless plating is preferred from the standpoint of dimensional stability. The type of electroless plating used here can be exemplified by nickel plating, copper plating, gold plating, and plating with various alloys.

The plating thickness is preferably at least 0.05 μm, and a plating thickness from 0.10 μm to 30.00 μm is preferred based on a consideration of the balance between production efficiency and anti-corrosion performance. The cylindrical shape of the support may be a solid cylindrical shape or a hollow cylindrical shape (tubular shape). The outer diameter of the support is preferably in the range from 3 mm to 10 mm.

When a medium-resistance layer or insulating layer is present between the support and the conductive layer, it may then not be possible to rapidly supply charge after charge has been consumed by electrical discharge. Thus, preferably either the conductive layer is directly disposed on the support or the conductive layer is disposed on the outer periphery of the support with only an interposed intermediate layer including a conductive thin-film resin layer, e.g., a primer.

A selection from known primers, in conformity with, e.g., the material of the support and the rubber material used to form the conductive layer, can be used as this primer. The material of the primer can be exemplified by thermosetting resins and thermoplastic resins, and known materials such as phenolic resins, urethane resins, acrylic resins, polyester resins, polyether resins, and epoxy resins can specifically be used.

The Conductive Layer

The conductive layer has a matrix and a plurality of domains dispersed in the matrix. In addition, the matrix contains a first rubber and the domains contain a second rubber and an electronic conductive agent. The matrix and domains satisfy the following component factors (i) to (iii).

component factor (i): The volume resistivity R1 of the matrix is larger than $1.00\times10^{12}$ Ω·cm.

component factor (ii): The surface roughness Ra of the outer surface of the conductive member is not more than 2.00 μm.

component factor (iii): The Martens hardness G1 of the matrix portion when measured at a load of 1 mN, and the Martens hardness G2 of the domain portion when measured at a load of 1 mN, satisfy the relationship G1<G2.

Component Factor (i): Matrix Volume Resistivity

By having the volume resistivity R1 of the matrix be greater than $1.00\times10^{12}$ Ω·cm, the movement of charge in the matrix while circumventing the domains can be suppressed. In addition, consumption of the majority of accumulated charge by a single electrical discharge can be suppressed. Moreover, this can prevent the charge accumulated in the domains, through its leakage into the matrix, from providing a condition as if conduction pathways that communicate within the conduction layer were to be formed.

The volume resistivity R1 is preferably at least $2.00\times10^{12}$ Ω·cm.

The upper limit on R1, on the other hand, is not particularly limited, but as a guide not more than $1.00\times10^{17}$ Ω·cm is preferred and not more than $8.00\times10^{16}$ Ω·cm is more preferred.

The present inventors believe that a structure in which regions where charge is satisfactorily accumulated (domains) are partitioned off by an electrically insulating region (matrix), is effective for bringing about charge transfer via the domains in the conductive layer and achieving microdischarge. In addition, by having the matrix volume resistivity be in the range of a high-resistance region as indicated above, adequate charge can be kept at the interface with each domain and charge leakage from the domains can also be suppressed.

In addition, in order for the electrical discharge to achieve a level of electrical discharge that is necessary and sufficient and a microdischarge, it is very effective to limit the charge transfer pathways to domain-mediated pathways. By suppressing charge leakage from the domains into the matrix and limiting the charge transport pathways to pathways that proceed via a plurality of domains, the density of the charge present on the domains can be boosted and due to this the amount of charge loaded at each domain can be further increased.

It is thought that this supports an increase, at the surface of the domains in their role as a conductive phase that is the source of the electrical discharge, in the overall charge population able to participate in electrical discharge, and that as a result the ease of electrical discharge elaboration from the surface of the conductive member can be enhanced.

Method for Measuring the Volume Resistivity of the Matrix:

The volume resistivity of the matrix can be measured with microprobes on thin sections prepared from the conductive layer. A means that can produce a very thin sample, such as a microtome, can be used as the means for preparing the thin sections. The specific procedure is described below.

Component Factor (ii): The Surface Roughness Ra of the Conductive Layer

The surface roughness Ra of the outer surface of the conductive member must be not more than 2.00 μm. When the surface roughness Ra is not more than 2.00 μm, the external additive is then able to undergo suitable rolling in the nip region between the conductive member and the photosensitive drum. Due to this, the external additive is unlikely to remain between the domains and the photosensitive drum and the generation of image defects is then impeded and the occurrence of scratching of the photosensitive drum is also inhibited. When, on the other hand, Ra is greater than 2.00 μm, rolling by the external additive is then unsatisfactory and the occurrence of scratching of the photosensitive drum can occur.

The surface roughness Ra is preferably not more than 1.00 μm. There are no particular limitations on the lower limit here, but at least 0.30 μm is preferred and at least 0.60 μm is more preferred. The surface roughness Ra can be adjusted as appropriate through, for example, the selection of the materials constituting the domains and matrix and through the polishing conditions.

The method for measuring the surface roughness Ra is described below.

Component Factor (iii): The Martens Hardness

At least a portion of the plurality of domains dispersed in the matrix are exposed at the outer surface of the conductive member. The outer surface of the conductive member is therefore constituted of the matrix and the exposed portions of the domains.

Defining G1 as the Martens hardness determined by the method described below for indenter contact with the matrix exposed at the outer surface of the conductive member, and defining G2 as the Martens hardness determined by the method described below for indenter contact with a domain exposed at the outer surface of the conductive member, G1 and G2 are satisfy the relationship G1<G2.

The Martens hardnesses G1 and G2 are not parameters that represent the hardness of the matrix as a bulk phase or the hardness of the domains as a bulk phase, but rather are parameters that represent the hardnesses of the conductive layer at the matrix portions and exposed domain portions that form the outer surface of the conductive layer.

That is, the Martens hardness measured from the outer surface of the conductive layer governs the pressure received when the external additive and toner located on this outer surface are pressed in the nip formed by the electrophotographic photosensitive member and the conductive member.

Having the relationship G1<G2 be satisfied means that the outer surface of the conductive member does not have a uniform hardness. It is thought that the external additive attached to this outer surface then undergoes rolling even more readily.

In addition, G1 and G2 preferably are both in the range from 1.0 $N/mm^2$ to 10.0 $N/mm^2$. In this case, deformation of the toner in the nip is inhibited, and due to this transfer of the external additive from the toner to the photosensitive member can be suppressed.

G1 is preferably 1.0 $N/mm^2$ to 8.0 $N/mm^2$ and is more preferably 1.8 $N/mm^2$ to 7.0 $N/mm^2$.

G2 is preferably 1.5 $N/mm^2$ to 10.0 $N/mm^2$ and is more preferably 2.2 $N/mm^2$ to 8.0 $N/mm^2$.

G2-G1 is preferably 0.2 $N/mm^2$ to 8.0 $N/mm^2$ and is more preferably 0.3 $N/mm^2$ to 6.0 $N/mm^2$.

The Martens hardnesses G1 and G2 can be controlled through, for example, the properties of the first rubber constituting the matrix, the degree of crosslinking of the first rubber, the type of additives for the matrix, the amount of addition of these additives, the properties of the second rubber constituting the domains, the degree of crosslinking of the second rubber, the amount of electronic conductive agent in the domains, and the abundance of the domains in the matrix.

G1 and G2 preferably are controlled primarily through the degree of crosslinking of the rubber.

From the viewpoint of bringing G1 and G2 into the ranges indicated above, the degree of crosslinking of the rubbers can be adjusted specifically through the types and amounts of addition of the vulcanizing agents and vulcanization accelerators. For example, sulfur may be used as the vulcanizing agent. The amount of sulfur is preferably adjusted as appropriate in conformity with the type and amount of rubber being used. From 0.5 mass parts to 8.0 mass parts per 100 mass parts of the rubber component in the unvulcanized rubber composition is preferred.

A thorough curing of the vulcanizate can be brought about by having the amount of sulfur be at least 0.5 mass parts. In addition, the use of not more than 8.0 mass parts for the amount of sulfur can prevent the crosslinking in and hardness of the vulcanizate from becoming too high.

The vulcanization accelerator can be exemplified by thiuram types, thiazole types, guanidine types, sulfenamide types, dithiocarbamate salt types, and thiourea types. Among the preceding, thiuram-type vulcanization accelerators are preferred because they are highly effective as vulcanization accelerators in the vulcanization of the first rubber and second rubber and facilitate adjustment of G1 and G2.

Thiuram-type vulcanization accelerators can be exemplified by tetramethylthiuram disulfide (TT), tetraethylthiuram disulfide (TET), tetrabutylthiuram disulfide (TBTD), tetraoctylthiuram disulfide (TOT), and so forth.

The content of the vulcanization accelerator in the unvulcanized rubber composition is preferably from 0.5 mass parts to 4.0 mass parts of the vulcanization accelerator per 100 mass parts of the rubber component in the unvulcanized rubber composition. A satisfactory effect as a vulcanization accelerator is obtained when at least 0.5 mass parts is used. When not more than 4.0 mass parts is used, vulcanization is not overly accelerated and G1 and G2 are readily brought into the ranges indicated above.

Component Factor (iv): Domain Volume Resistivity

The volume resistivity R2 of the domains is less than the volume resistivity R1 of the matrix. This facilitates restricting the charge transport pathways to pathways via a plurality of domains, while suppressing unwanted charge transport by the matrix.

The volume resistivity R1 is preferably at least $1.0\times10^5$-times the volume resistivity R2. R1 is more preferably $1.0\times10^5$-times to $1.0\times10^{18}$-times R2, still more preferably $1.0\times10^6$-times to $1.0\times10^{17}$-times R2, and even more preferably $8.0\times10^6$-times to $1.0\times10^{16}$-times R2.

In addition, R2 is preferably from $1.00\times10^1$ Ω·cm to $1.00\times10^4$ Ω·cm and more preferably from $1.00\times10^1$ Ω·cm to $1.00\times10^2$ Ω·cm.

By satisfying the preceding, the charge transport paths in the conductive layer can be controlled and microdischarge is more readily achieved. Due to this, even when the very small amount of external additive is inserted between the conductive member and photosensitive drum, white spot image defects are more readily suppressed.

The volume resistivity of the domains is adjusted, for example, by bringing the conductivity of the rubber component of the domains to a prescribed value by changing the type and amount of the electronic conductive agent.

A rubber composition containing a rubber component for use for the matrix can be used as the rubber material for the domains. In order to form a matrix-domain structure, the difference in the solubility parameter (SP value) from the rubber material forming the matrix is preferably brought into a prescribed range. That is, the absolute value of the difference between the SP value of the first rubber and the SP value of the second rubber is preferably from 0.4 $(J/cm^3)^{0.5}$ to 5.0 $(J/cm^3)^{0.5}$ and more preferably from 0.4 $(J/cm^3)^{0.5}$ to 2.2 $(J/cm^3)^{0.5}$.

The domain volume resistivity can be adjusted through judicious selection of the type of electronic conducting agent and its amount of addition. With regard to the electronic conducting agent used to control the domain volume resistivity to from $1.00\times10^1$ Ω·cm to $1.00\times10^4$ Ω·cm, preferred electronic conducting agents are those that can bring about large variations in the volume resistivity, from a high resistance to a low resistance, as a function of the amount that is dispersed.

The electronic conducting agent blended in the domains can be exemplified by carbon black; graphite; oxides such as titanium oxide, tin oxide, and so forth; metals such as Cu, Ag, and so forth; and particles rendered conductive by coating the surface with an oxide or metal. As necessary, a blend of suitable quantities of two or more of these conducting agents may be used.

Among these electronic conducting agents, the use is preferred of conductive carbon black, which has a high affinity for rubber and supports facile control of the electronic conducting agent-to-electronic conducting agent distance. There are no particular limits on the type of carbon black blended into the domains. Specific examples are gas furnace black, oil furnace black, thermal black, lamp black, acetylene black, and Ketjenblack.

Among the preceding, a conductive carbon black having a DBP absorption from 40 $cm^3$/100 g to 170 $cm^3$/100 g, which can impart a high conductivity to the domains, can be favorably used.

The content of the electronic conducting agent, e.g., conductive carbon black, is preferably from 20 mass parts to 150 mass parts per 100 mass parts of the second rubber contained in the domains. From 50 mass parts to 100 mass parts is more preferred.

The conducting agent is preferably blended in larger amounts than for ordinary electrophotographic conductive members. Doing this makes it possible to easily control the volume resistivity of the domains into the range from $1.00\times10^1$ Ω·cm to $1.00\times10^4$ Ω·cm.

The fillers, processing aids, co-crosslinking agents, crosslinking accelerators, ageing inhibitors, crosslinking co-accelerators, crosslinking retarders, softeners, dispersing agents, colorants, and so forth that are ordinarily used as rubber blending agents may as necessary be added to the rubber composition for the domains within a range in which the effects according to the present disclosure are not impaired.

Method for Measuring the Volume Resistivity of the Domains:

Measurement of the volume resistivity of the domains may be carried out using the same method as the method for measuring the volume resistivity of the matrix, but changing the measurement location to a location corresponding to a domain and changing the voltage applied during measurement of the current value to 1 V. The specific procedure is described below.

Component Factor (v): Distance Between Adjacent Walls of the Domains>

From the standpoint of bringing about charge transfer between domains, the arithmetic-mean value Dm of the distance between adjacent walls of the domains (also referred to herebelow simply as the "interdomain distance Dm"), in observation of the cross section in the thickness direction of the conductive layer, is preferably not more than 2.00 μm and more preferably not more than 1.00 μm.

In addition, in order for the domains to be securely electrically partitioned from one another by an insulating region (matrix) and enable charge to be readily accumulated by the domains, the interdomain distance Dm is preferably at least 0.15 μm and more preferably at least 0.20 μm.

Method for Measuring the Interdomain Distance Dm:

Measurement of the interdomain distance Dm may be carried out using the following method.

First, a section is prepared using the same method as the method used in measurement of the volume resistivity of the matrix, supra. In order to favorably carry out observation of the matrix-domain structure, a pretreatment that provides good contrast between the conductive phase and insulating phase may be carried out, e.g., a staining treatment, vapor deposition treatment, and so forth.

The presence of a matrix-domain structure is checked by observation using a scanning electron microscope (SEM) of the section after formation of a fracture surface and platinum vapor deposition. The SEM observation is preferably carried out at 5000× from the standpoint of the accuracy of quantification of the domain area. The specific procedure is described below.

Uniformity of the Interdomain Distance Dm:

The interdomain distance Dm preferably has a uniform distribution in order to enable the formation of a more stable microdischarge. Having a uniform distribution for the interdomain distance Dm makes it possible to reduce phenomena that impair the ease of electrical discharge elaboration, e.g., the occurrence of locations where charge supply is delayed relative to the surroundings due to the presence to some degree of locations within the conductive layer where the interdomain distance is locally longer.

Figure 3A:
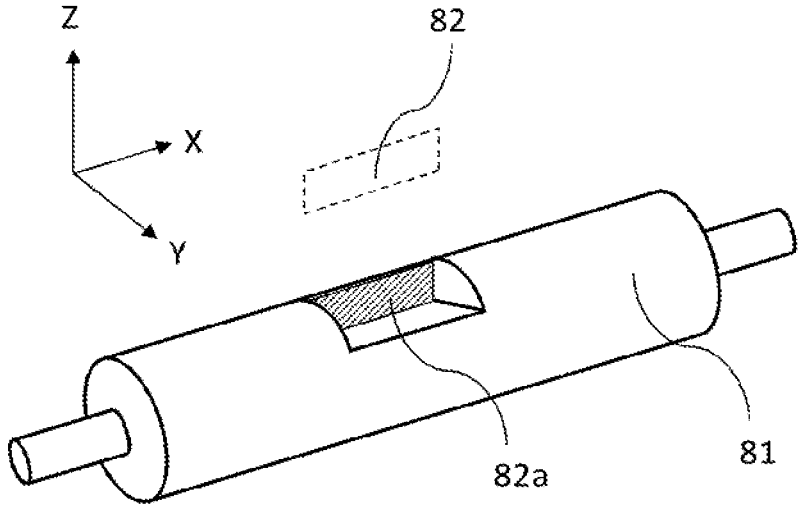
FIGS. 3A and 3B are explanatory diagrams of a charging roller for the direction of cross section excision from the conductive layer.
Figure 3B:
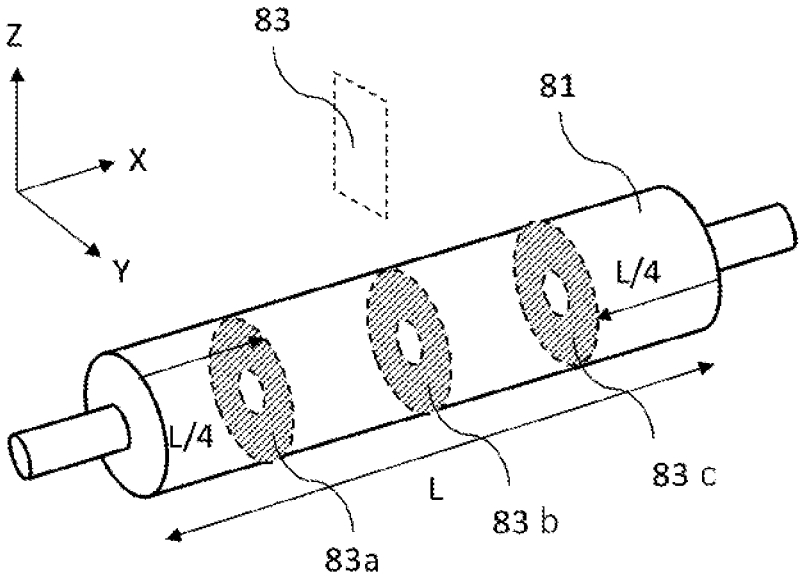

Operating in the charge transport cross section, i.e., the cross section in the thickness direction of the conductive layer as shown in FIG. 3B, a 50 μm-square region of observation is taken at three randomly selected locations in the thickness region at a depth of 0.1 T to 0.9 T from the outer surface of the conductive layer in the direction of the support. In this case, and using the interdomain distance Dm within these regions of observation and the standard deviation om of the distribution of the interdomain distance, the variation coefficient σm/Dm for the interdomain distance is preferably from 0 to 0.40 and is more preferably from 0.10 to 0.30.

Method for Measuring the Uniformity of the Interdomain Distance Dm:

The uniformity of the interdomain distance can be measured by quantification of the image obtained by direct observation of the fracture surface as in the measurement of the interdomain distance. The specific procedure is described below.

The conductive member can be formed, for example, via a method including the following steps (i) to (iv):

step (i): a step of preparing a domain-forming rubber mixture (also referred to hereafter as "CMB") containing carbon black and a second rubber;

step (ii): a step of preparing a matrix-forming rubber mixture (also referred to hereafter as "MRC") containing a first rubber;

step (iii): a step of preparing a rubber mixture having a matrix-domain structure by kneading the CMB with the MRC; and step (iv): a step of forming a conductive layer by forming a layer of the rubber mixture prepared in step (iii) on a conductive support, either directly thereon or via another layer, and curing the rubber mixture layer.

Component factors (i) to (v) can be controlled, for example, through the selection of the materials used in the individual steps described above and through adjustment of the production conditions. This is described in the following.

First, with regard to component factor (i), the volume resistivity of the matrix is governed by the composition of the MRC.

Low-conductivity rubbers are preferred for the first rubber that is used in the MRC. At least one selection from the group consisting of natural rubber, butadiene rubber, butyl rubber, acrylonitrile-butadiene rubber, urethane rubber, silicone rubber, fluorocarbon rubber, isoprene rubber, chloroprene rubber, styrene-butadiene rubber, ethylene-propylene rubber, ethylene-propylene-diene rubber, and polynorbornene rubber is preferred.

The first rubber is more preferably at least one selection from the group consisting of butyl rubber, styrene-butadiene rubber, and ethylene-propylene-diene rubber.

The following may be added to the MRC on an optional basis as long as the volume resistivity of the matrix is in the range given above: fillers, processing aids, crosslinking agents, co-crosslinking agents, crosslinking accelerators, crosslinking co-accelerators, crosslinking retarders, ageing inhibitors, softeners, dispersing agents, colorants, and so forth. On the other hand, in order to bring the matrix volume resistivity into the range indicated above, an electronic conducting agent, e.g., carbon black, is preferably not incorporated in the MRC.

In relation to component factor (iv), the domain volume resistivity R2 can be adjusted using the amount of the electronic conducting agent in the CMB. For example, considering the example of the use as the electronic conducting agent of a conductive carbon black having a DBP absorption of from 40 $cm^3$/100 g to 170 $cm^3$/100 g, the desired range can be achieved by preparing a CMB that contains from 40 mass parts to 200 mass parts of the conductive carbon black per 100 mass parts of the second rubber in the CMB.

In addition, controlling the following (a) to (d) is effective with regard to the state of domain dispersion in relation to component factor (v):

(a) the difference between the interfacial tensions σ of the CMB and the MRC;

(b) the ratio between the viscosity of the MRC (ηm) and the viscosity of the CMB (ηd) (ηm/ηd);

(c) the shear rate (γ) and the amount of energy during shear (EDK) when the CMB and the MRC are kneaded in step (iii); and (d) the volume fraction of the CMB relative to the MRC in step (iii).

(a) The Difference in Interfacial Tension Between the CMB and the MRC

Phase separation generally occurs when two species of incompatible rubbers are mixed. This occurs because the interaction between the same species of polymer molecules is stronger than the interaction between different species of polymer molecules, resulting in aggregation between the same species of polymer molecules, a reduction in free energy, and stabilization.

The interface in a phase-separated structure, due to contact with a different species of polymer molecules, assumes a higher free energy than the interior, which is stabilized by the interaction between polymer molecules of the same species. As a result, in order to lower the interfacial free energy, an interfacial tension occurs directed to reducing the area of contact with the different species of polymer molecules. When this interfacial tension is small, this moves in the direction of a more uniform mixing, even by different species of polymer molecules, to increase the entropy. A uniformly mixed state is dissolution, and there is a tendency for the interfacial tension to correlate with the SP value (solubility parameter), which is a metric for solubility.

Thus, the difference in interfacial tension between the CMB and the MRC is thought to correlate with the difference in the SP values of the rubbers contained by each. Rubbers are preferably selected whereby the absolute value of the difference between the solubility parameter SP value of the first rubber in the MRC and the SP value of the second rubber in the CMB is preferably from 0.4 $(J/cm^3)^{0.5}$ to 5.0 $(J/cm^3)^{0.5}$ and is more preferably from 0.4 $(J/cm^3)^{0.5}$ to 2.2 $(J/cm^3)^{0.5}$. Within this range, a stable phase-separated structure can be formed and a small CMB domain diameter can be established.

Specific preferred examples of second rubbers that can be used in the CMB here are, for example, at least one selection from the group consisting of natural rubber (NR), isoprene rubber (IR), butadiene rubber (BR), acrylonitrile-butadiene rubber (NBR), styrene-butadiene rubber (SBR), butyl rubber (IIR), ethylene-propylene rubber (EPM), ethylene-propylene-diene rubber (EPDM), chloroprene rubber (CR), nitrile rubber (NBR), hydrogenated nitrile rubber (H-NBR), silicone rubber, and urethane rubber (U).

The second rubber is more preferably at least one selection from the group consisting of styrene-butadiene rubber (SBR), butyl rubber (IIR), and acrylonitrile-butadiene rubber (NBR) and is still more preferably at least one selection from the group consisting of styrene-butadiene rubber (SBR), and butyl rubber (IIR).

The thickness of the conductive layer is not particularly limited as long as the desired functions and effects are obtained for the conductive member. The thickness of the conductive layer is preferably from 1.0 mm to 4.5 mm.

The mass ratio between the domains and the matrix (domain:matrix) is preferably 5:95 to 40:60, more preferably 10:90 to 30:70, and still more preferably 13:87 to 25:75.

Method for Measuring the SP Value

The SP value can be determined with good accuracy by constructing a calibration curve using materials having already known SP values. Catalogue values provided by the material manufacturers may also be used as these already known SP values. For example, for NBR and SBR, the SP value is almost entirely determined by the content ratio for the acrylonitrile and styrene independently of the molecular weight.

Accordingly, the content ratio for acrylonitrile or styrene for the rubber constituting the matrix and domains is analyzed using an analytic procedure, e.g., pyrolysis gas chromatography (Py-GC) and solid-state NMR. By doing this, the SP value can be determined from a calibration curve obtained from materials for which the SP value is already known.

In addition, with an isoprene rubber, the SP value is governed by the isomer structure, e.g., 1,2-polyisoprene, 1,3-polyisoprene, 3,4-polyisoprene, cis-1,4-polyisoprene, trans-1,4-polyisoprene, and so forth. Thus, the isomer content ratio is analyzed using, e.g., Py-GC and solid-state NMR, as for SBR and NBR and the SP value can be determined from materials for which the SP value is already known.

The SP values of materials having already known SP values are determined using the Hansen sphere method.

(b) Viscosity Ratio Between the CMB and the MRC

The domain diameter declines as the viscosity ratio between the CMB and the MRC (CMB/MRC) ($\eta d/\eta m$) approaches 1. Specifically, this viscosity ratio is preferably from 1.0 to 2.0. The viscosity ratio between the CMB and the MRC can be adjusted through selection of the Mooney viscosity of the starting rubbers used for the CMB and the MRC and through the filler type and its amount of incorporation.

A plasticizer, e.g., paraffin oil, may also be added to the extent this does not hinder the formation of a phase-separated structure. The viscosity ratio may also be adjusted by adjusting the temperature during kneading.

The viscosity of the rubber mixture for domain formation and the viscosity of the rubber mixture for matrix formation are obtained by measurement of the Mooney viscosity $ML_{(1+4)}$ based on JIS K 6300-1: 2013; the measurement is performed at the temperature of the rubber during kneading.

(c) The Shear Rate and the Amount of Energy During Shear when the CMB is Kneaded with the MRC The interdomain distance Dm and Dms become smaller as the shear rate during kneading of the CMB with the MRC becomes faster and as the amount of energy during shear becomes larger.

The shear rate can be increased by increasing the inner diameter of the stirring members of the kneader, i.e., the blades and screw, to reduce the gap between the end face of the stirring members and the inner wall of the kneader, and by raising the rotation rate. An increase in the energy during shear can be achieved by raising the rotation rate of the stirring members and raising the viscosity of the first rubber in the CMB and the second rubber in the MRC.

(d) Volume Fraction of the CMB Relative to the MRC

The volume fraction of the CMB relative to the MRC correlates with the collisional coalescence probability for the domain-forming rubber mixture relative to the matrix-forming rubber mixture. Specifically, when the volume fraction of the domain-forming rubber mixture relative to the matrix-forming rubber mixture is reduced, the collisional coalescence probability for the domain-forming rubber mixture and matrix-forming rubber mixture declines. Thus, the interdomain distance Dm and Dms can be made smaller by lowering the volume fraction of the domains in the matrix in the range in which the required conductivity is obtained.

The volume ratio of the CMB relative to the MRC (that is, the volume ratio of the domains to the matrix) is preferably from 15% to 40%.

Using L for the length in the longitudinal direction of the conductive layer in the conductive member and using T for the thickness of this conductive layer, cross sections in the thickness direction of the conductive layer are acquired, as shown in FIG. 3B, at three locations, i.e., at the center in the longitudinal direction of the conductive layer and at L/4 toward the center from both ends of the conductive layer. The following are preferably satisfied at each of the thickness direction cross sections in the conductive layer.

At each of these cross sections, a 15 μm-square region of observation is set up at three randomly selected locations in the thickness region at a depth of 0.1 T to 0.9 T from the outer surface of the conductive layer, and preferably at least 80 number % of the domains observed at each of all nine regions of observation satisfies the following component factors (vi) and (vii).

component factor (vi)

The percentage μr for the cross-sectional area of the electronic conducting agent present in a domain with respect to the cross-sectional area of the domain is at least 20%.

component factor (vii)

A/B is from 1.00 to 1.10 where A is the periphery length of the domain and B is the envelope periphery length of the domain.

Component factors (vi) and (vii) can be regarded as specifications related to domain shape. This "domain shape" is defined as the cross-sectional shape of the domain visualized in the cross section in the thickness direction of the conductive layer.

The domain shape is preferably a shape that lacks unevenness in its peripheral surface, i.e., is a shape approximating a sphere. Reducing the number of uneven structures associated with the shape can reduce nonuniformity of the electric field between domains, i.e., can reduce locations where electric field concentration is produced and can reduce the phenomenon of the occurrence of unwanted charge transport in the matrix.

The present inventors have found that the amount of electronic conducting agent contained in one domain exercises an effect on the external shape of that domain. That is, it was found that, as the amount of loading of one domain with the electronic conducting agent increases, the external shape of that domain becomes closer to that of a sphere. A larger number of near-spherical domains results in ever fewer concentration points for electron transfer between domains.

Moreover, according to investigations by the present inventors, a near-spherical shape is better assumed by domains for which the total percentage μr, with reference to the area of the cross section of one domain, for the cross-sectional area of the electronic conducting agent observed in that cross section is at least 20%.

As a result, an external shape can be assumed that can significantly relax the concentration of electron transfer between domains, and this is thus preferred. Specifically, the percentage μr, with reference to the area of the cross section of a domain, for the cross-sectional area of the electronic conducting agent present in that domain is preferably at least 20%. 25% to 30% is more preferred.

A satisfactory amount of charge supply is made possible, even in high-speed processes, by satisfying the aforementioned range.

The present inventors discovered that the following formula (5) is preferably satisfied in relation to a shape that lacks unevenness on the peripheral surface of the domain.

$$1.00 \leq A/B \leq 1.10 \quad (5)$$

(A: periphery length of domain, B: envelope periphery length of domain)

Figure 6:
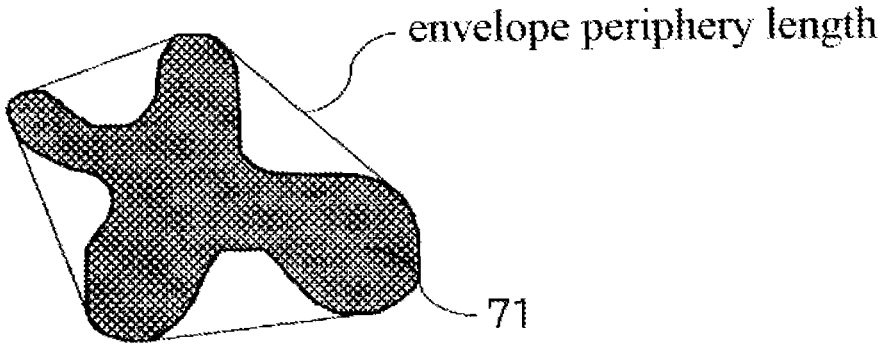
FIG. 6 is an explanatory diagram of the envelope periphery length of a domain.

Formula (5) indicates the ratio between the domain periphery length A and the domain envelope periphery length B. The envelope periphery length here is the periphery length, as shown in FIG. 6, when the protruded portions of a domain 71 observed in a region of observation are connected.

The ratio between the domain periphery length and domain envelope periphery length has a minimum value of 1, and a value of 1 indicates that the domain has a shape that lacks depressed portions in its cross-sectional shape, e.g., a perfect circle, ellipse, and so forth. When this ratio is equal to or less than 1.1, this indicates that large uneven shapes are not present in the domain and the expression of electric field anisotropy is suppressed.

Method for Measuring Each of the Parameters Related to Domain Shape

An ultrathin section having a thickness of 1 μm is sectioned out at an excision temperature of −100° C. from the conductive layer of the conductive member (conductive roller) using a microtome (product name: Leica EMFCS, Leica Microsystems GmbH). However, as indicated in the following, evaluation of the domain shape must be carried out on the fracture surface of a section prepared using a cross section orthogonal to the longitudinal direction of the conductive member. The reason for this is as follows.

FIG. 3A and FIG. 3B give diagrams that show the shape of a conductive member 81 using three axes and specifically the X, Y, and Z axes in three dimensions. The X axis in FIG. 3A and FIG. 3B shows the direction parallel to the longitudinal direction (axial direction) of the conductive member, and the Y axis and Z axis show the directions orthogonal to the axial direction of the conductive member.

FIG. 3A shows an image diagram for a conductive member, in which the conductive member has been cut out at a cross section 82*a* that is parallel to the XZ plane 82. The XZ plane can be rotated 3600 centered on the axis of the conductive member. Considering that the conductive member rotates abutting a photosensitive drum and discharges upon the passage of a gap with the photosensitive drum, the cross section 82*a* parallel to the XZ plane 82 thus indicates a plane where discharge occurs simultaneously with a certain timing. The surface potential of the photosensitive drum is formed by the passage of a plane corresponding to a certain portion of the cross section 82*a*.

Accordingly, in order to evaluate the domain shape, which correlates with concentration of the electric field within the conductive member, rather than analysis of a cross section where discharge occurs simultaneously in a certain instant such as the cross section 82*a*, evaluation is required at a cross section parallel to the YZ plane 83 orthogonal to the axial direction of the conductive member, which enables evaluation of a domain shape that contains a certain portion of the cross section 82*a*.

Using L for the length of the conductive layer in the longitudinal direction, a total of three locations are selected for this evaluation, i.e., the cross section 83*b* at the center in the longitudinal direction of the conductive layer and cross sections (83*a* and 83*c*) at two positions that are L/4 toward the center from either end of the conductive layer.

In addition, in relation to the location of observation in cross sections 83*a* to 83*c* and using T for the thickness of the conductive layer, the measurement should be carried out at a total of nine regions of observation wherein a 15 μm-square region of observation is taken at three randomly selected locations in the thickness region at a depth of 0.1 T to 0.9 T from the outer surface of each section.

Vapor-deposited sections are obtained by executing platinum vapor deposition on the obtained sections. The surface of the vapor-deposited section is then magnified 1,000× or 5,000× using a scanning electron microscope (SEM) (product name: S-4800, Hitachi High-Technologies Corporation) and an observation image is acquired.

In order to quantify the domain shapes in this analysis image, a 256-gradation monochrome image is then obtained by carrying out 8-bit grey scale conversion using image processing software (product name: Image-Pro Plus, Media Cybernetics, Inc.). White/black reversal processing is subsequently carried out on the image so the domains in the fracture surface become white and a binarized image is obtained.

Method for Measuring the Cross-Sectional Area Percentage μr for the Electronic conducting agent in the Domain The cross-sectional area percentage for the electronic conducting agent in a domain can be measured by quantification of the binarized image of the aforementioned observation image that has been magnified 5,000×.

A 256-gradation monochrome image is obtained by carrying out 8-bit grey scale conversion using image processing software (product name: Image-Pro Plus, Media Cybernetics, Inc.). A binarized image is obtained by binarizing the observation image so as to enable differentiation of the carbon black particles. The following are determined using the count function on the obtained image: the cross-sectional area S of the domains within the analysis image and the total cross-sectional area Sc of the carbon black particles, i.e., the electronic conducting agent, present in the domains.

The arithmetic-mean value μr of Sc/S at the nine locations is calculated to give the cross-sectional area percentage for the electronic conductive material in the domains.

The cross-sectional area percentage μr of the electronic conducting agent influences the uniformity of the domain volume resistivity. The uniformity of the domain volume resistivity can be measured as follows in combination with the measurement of the cross-sectional area percentage μr.

Using the measurement method described in the preceding, σr/μr is calculated, as a metric of the uniformity of domain volume resistivity, from μr and the standard deviation or for μr.

Method for Measuring the Periphery Length A and the Envelope Periphery Length B of the Domains Using the count function of the image processing software, the following items are determined on the domain population present in the binarized image of the aforementioned observation image that had been magnified 1,000×.

periphery length A (μm)

envelope periphery length B (μm)

These values are substituted into the following formula (5), and the arithmetic-mean value for the evaluation images at the nine locations is used.

$$1.00 \leq A/B \leq 1.10 \quad (5)$$

(A: periphery length of domain, B: envelope periphery length of domain)

Method for Measuring the Domain Shape Index

The domain shape index may be determined as the number percentage, with reference to the total number of domains, for the domain population that has a μr (area %) of at least 20% and a domain periphery length ratio A/B that satisfies the preceding formula (5). The domain shape index is preferably from 80 number % to 100 number %.

Using the count function of the image processing software (product name: Image-Pro Plus, Media Cybernetics, Inc.) on the binarized image described above, the size of the domain population within the binarized image is determined and the number percentage of the domains that satisfy μr≥20 and the preceding formula (5) may also be acquired.

By implementing a high density loading by the electronic conducting agent in a domain, as stipulated by component factor (vi), the external shape of the domain can be brought close to that of a sphere, and a low unevenness as stipulated in component factor (v) can also be established.

In order to obtain domains densely loaded with the electronic conducting agent, as stipulated by component factor (vi), the electronic conducting agent preferably has carbon black having a DBP absorption from 40 $cm^3$/100 g to 80 $cm^3$/100 g.

The DBP absorption ($cm^3$/100 g) is the volume of dibutyl phthalate (DBP) that can be absorbed by 100 g of a carbon black and is measured in accordance with Japanese Industrial Standard (JIS) K 6217-4: 2017 (Carbon black for rubber industry—Fundamental characteristics—Part 4: Determination of oil absorption number (including compressed samples)).

Carbon blacks generally have a floc-like higher-order structure in which primary particles having an average particle diameter from 10 nm to 50 nm are aggregated. This floc-like higher-order structure is referred to as "structure", and its extent is quantified by the DBP absorption ($cm^3$/100 g).

A conductive carbon black having a DBP absorption in the indicated range has an undeveloped level of structure, and due to this there is little aggregation of the carbon black and the dispersibility in rubber is excellent. As a consequence, a high loading level in the domains can be achieved, and as a result domains having an external shape more nearly approaching spherical are readily obtained.

In addition, a conductive carbon black having a DBP absorption in the indicated range is resistant to aggregate formation, and as a consequence the formation of domains according to factor (vii) is facilitated.

The Domain Diameter D

The arithmetic-mean value of the circle-equivalent diameter D (also referred to herebelow simply as the "domain diameter D") of the domains observed in the cross section of the conductive layer is preferably from 0.10 μm to 5.00 μm.

When this range is adopted, the surfacemost domains assume a size equal to or less than that of the toner, and as a result a fine electrical discharge is made possible and achieving a uniform electrical discharge is facilitated.

By having the average value of the domain diameter D be at least 0.10 in, the charge movement pathways in the conductive layer can be more effectively limited to the desired pathways. At least 0.15 μm is more preferred, and at least 0.20 μm is still more preferred.

By having the average value of the domain diameter D be not more than 5.00 μm, the proportion of the domain surface area to its total volume, i.e., the domain specific surface area, can be exponentially increased and the efficiency of charge discharge from the domains can be very substantially increased. For this reason, the average value of the domain diameter D is preferably not more than 2.00 μm and is more preferably not more than 1.00 μm.

By having the average value of the domain diameter D be not more than 2.00 μm, the electrical resistance of the domain itself can be reduced and due to this the amount of the single-event electrical discharge is brought to the necessary and sufficient amount and a more efficient microdischarge is made possible.

Viewed from the standpoint of pursuing further reductions in electric field concentration between domains, the external shape of the domains preferably more nearly approaches that of a sphere. Due to this, smaller domain diameters within the aforementioned range are preferred. The method for this can be exemplified by kneading the MRC with the CMB in step (vi) to induce phase separation between the MRC and the CMB. Another exemplary method is to exercise control, in the step of preparing a rubber mixture in which CMB domains are formed in the MRC matrix, so as to provide a small CMB domain diameter.

By providing a small CMB domain diameter, the specific surface area of the CMB is increased and the interface with the matrix is enlarged, and due to this a tension acts directed to reducing the tension at the interface of the CMB domain. As a result, the external shape of the CMB domain more nearly approaches that of a sphere.

Taylor's formula (formula (6)), Wu's empirical formulas (formulas (7) and (8)), and Tokita's formula (formula (9)) are known with regard to the factors that govern the domain diameter in a matrix-domain structure formed when two species of incompatible polymers are melt-kneaded.

Taylor's formula $$D=[C\cdot\sigma/\eta m\cdot\gamma]\cdot f(\eta m/\eta d) \quad (6)$$

Wu's empirical formulas $$\gamma\cdot D\cdot\eta m/\sigma=4(\eta d/\eta m)0.84\cdot\eta d/\eta m>1 \quad (7)$$

$$\gamma\cdot D\cdot\eta m/\sigma=4(\eta d/\eta m)\cdot 0.84\cdot\eta d/\eta m<1 \quad (8)$$

Tokita's formula $$D=12\cdot P\cdot\sigma\cdot\phi/(\pi\cdot\eta\cdot\gamma)\cdot(1+4\cdot P\cdot\phi\cdot EDK/(\pi\cdot\eta\cdot\gamma)) \quad (9)$$

In formulas (6) to (9), D represents the maximum Feret diameter of the CMB domains; C represents a constant; a represents interfacial tension; ηm represents the viscosity of the matrix; ηd represents the viscosity of the domains; γ represents the shear rate; η represents the viscosity of the mixed system; P represents the collisional coalescence probability; ϕ represents the domain phase volume; and EDK represents the domain phase severance energy.

In order, in relation to component factor (v), to provide a uniform interdomain distance, it is effective to provide a small domain diameter in accordance with formulas (6) to (9). In addition, in the process, during the step of kneading the MRC with the CMB, of dividing up the starting rubber for the domains and gradually reducing the particle diameter thereof, the interdomain distance also varies depending on when the kneading step is halted.

Accordingly, the uniformity of the interdomain distance can be controlled using the kneading time in the kneading step and using the kneading rotation rate, which is an index for the intensity of this kneading, and the uniformity of the interdomain distance can be enhanced using a longer kneading time and a larger kneading rotation rate.

Uniformity of the Domain Diameter D:

The domain diameter D is preferably uniform and thus the particle size distribution is preferably narrow. By having a uniform distribution for the domain diameter D traversed by the charge in the conductive layer, charge concentration within the matrix-domain structure is suppressed and the ease of emanation of the electric discharge over the entire surface of the conductive member can be effectively increased.

When, operating in the charge transport cross section, i.e., the cross section in the thickness direction of the conductive layer as shown in FIG. 3B, a 50 μm-square region of observation is taken at three randomly selected locations in the thickness region at a depth of 0.1 T to 0.9 T from the outer surface of the conductive layer in the direction of the support, the σd/D ratio for the standard deviation ad of the domain diameter and the arithmetic-mean value D of the domain diameter (variation coefficient σd/D) is preferably from 0 to 0.40 and is more preferably from 0.10 to 0.30.

To bring about a better uniformity of the domain diameter, the uniformity of the domain diameter is also enhanced when a small domain diameter is established in accordance with formulas (6) to (9), which is equivalent to the aforementioned procedure for enhancing the uniformity of the interdomain distance. Moreover, in the process, during the step of kneading the MRC with the CMB, of dividing up the starting rubber for the domains and gradually reducing the particle diameter thereof, the uniformity of the domain diameter also varies depending on when the kneading step is halted.

Accordingly, the uniformity of the domain diameter can be controlled using the kneading time in the kneading step and using the kneading rotation rate, which is an index for the intensity of this kneading, and the uniformity of the domain diameter can be enhanced using a longer kneading time and a larger kneading rotation rate.

Method for Measuring the Uniformity of the Domain Diameter

The uniformity of the domain diameter can be measured by quantification of the image obtained by direct observation of the fracture surface, which is obtained by the same method for measurement of the uniformity of the interdomain distance as described above. The specific procedure is described below.

Method for Confirming the Matrix-Domain Structure

The presence of a matrix-domain structure in the conductive layer can be confirmed by preparing a thin section of the conductive layer and carrying out a detailed observation of the fracture surface formed on the thin section. The specific procedure is described below.

The Toner

The toner is described in the following.

The toner has a binder resin-containing toner particle and has an external additive externally added to the toner particle, wherein the external additive has primary particle having the shape factor SF-1 of not more than 115 and A<Dms is satisfied where A is the number-average primary particle diameter of the external additive and Dms is the arithmetic average value of the distance between adjacent walls between the domains in the conductive layer in observation of the outer surface of the conductive member.

Toner Particle Production Methods

The method for manufacturing the toner particle is explained here.

The method for manufacturing the toner is not particularly limited, and a known method may be used as the toner particle manufacturing method, such as a kneading pulverization method or wet manufacturing method. A wet manufacturing method is preferred from the standpoint of shape control and obtaining a uniform particle diameter. Examples of wet manufacturing methods include suspension polymerization methods, solution suspension methods, emulsion polymerization-aggregation methods, emulsion aggregation methods and the like, and an emulsion aggregation method is preferred.

In emulsion aggregation methods, materials such as a binder resin fine particle, and as necessary a colorant fine particle and the like are dispersed and mixed in an aqueous medium containing a dispersion stabilizer. A surfactant may also be added to the aqueous medium. A flocculant is then added to aggregate the mixture until the desired toner particle size is reached, and the resin fine particles are also fused together either after or during aggregation. Shape control with heat may also be performed as necessary in this method to form a toner particle.

The binder resin fine particle here may be a composite particle formed as a multilayer particle comprising two or more layers composed of resins with different compositions. This can be manufactured for example by an emulsion polymerization method, mini-emulsion polymerization method, phase inversion emulsion method or the like, or by a combination of multiple manufacturing methods.

When the toner particle contains an internal additive such as a colorant, the internal additive may be included originally in the resin fine particle, or a liquid dispersion of an internal additive fine particle consisting only of the internal additive may be prepared separately, and the internal additive fine particles may then be aggregated together when the resin fine particles are aggregated.

Resin fine particles with different compositions may also be added at different times during aggregation, and aggregated to prepare a toner particle composed of layers with different compositions.

The following may be used as the dispersion stabilizer:

inorganic dispersion stabilizers such as tricalcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica and alumina.

Other examples include organic dispersion stabilizers such as polyvinyl alcohol, gelatin, methyl cellulose, methyl hydroxypropyl cellulose, ethyl cellulose, carboxymethyl cellulose sodium salt, and starch.

A known cationic surfactant, anionic surfactant or nonionic surfactant may be used as the surfactant.

Specific examples of cationic surfactants include dodecyl ammonium bromide, dodecyl trimethylammonium bromide, dodecylpyridinium chloride, dodecylpyridinium bromide, hexadecyltrimethyl ammonium bromide and the like.

Specific examples of nonionic surfactants include dodecylpolyoxyethylene ether, hexadecylpolyoxyethylene ether, nonylphenylpolyoxyethylene ether, lauryl polyoxyethylene ether, sorbitan monooleate polyoxyethylene ether, styrylphenyl polyoxyethylene ether, monodecanoyl sucrose and the like.

Specific examples of anionic surfactants include aliphatic soaps such as sodium stearate and sodium laurate, and sodium lauryl sulfate, sodium dodecylbenzene sulfonate, sodium polyoxyethylene (2) lauryl ether sulfate and the like.

The Binder Resin

Preferred examples of the binder resin include vinyl resins, polyester resins and the like. Examples of vinyl resins, polyester resins and other binder resins include the following resins and polymers:

monopolymers of styrenes and substituted styrenes, such as polystyrene and polyvinyl toluene; styrene copolymers such as styrene-propylene copolymer, styrene-vinyl toluene copolymer, styrene-vinyl naphthalene copolymer, styrene-methyl acrylate copolymer, styrene-ethyl acrylate copolymer, styrene-butyl acrylate copolymer, styrene-octyl acrylate copolymer, styrene-dimethylaminoethyl acrylate copolymer, styrene-methyl methacrylate copolymer, styrene-ethyl methacrylate copolymer, styrene-butyl methacrylate copolymer, styrene-dimethylaminoethyl methacrylate copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-maleic acid copolymer and styrene-maleic acid ester copolymer; and polymethyl methacryalte, polybutyl methacrylate, polvinyl acetate, polyethylene, polypropylene, polvinyl butyral, silicone resin, polyamide resin, epoxy resin, polyacrylic resin, rosin, modified rosin, terpene resin, phenol resin, aliphatic or alicyclic hydrocarbon resins and aromatic petroleum resins.

The binder resin preferably contains vinyl resins, and more preferably contains styrene copolymers. These binder resins may be used individually or mixed together.

The binder resin preferably contains carboxyl groups, and is preferably a resin manufactured using a polymerizable monomer containing a carboxyl group. Examples of the polymerizable monomer containing a carboxyl group include vinylic carboxylic acids such as acrylic acid, methacrylic acid, α-ethylacrylic acid and crotonic acid; unsaturated dicarboxylic acids such as fumaric acid, maleic acid, citraconic acid and itaconic acid; and unsaturated dicarboxylic acid monoester derivatives such as monoacryloyloxyethyl succinate ester, monomethacryloyloxyethyl succinate ester, monoacryloyloxyethyl phthalate ester and monomethacryloyloxyethyl phthalate ester.

Polycondensates of the carboxylic acid components and alcohol components listed below may be used as the polyester resin. Examples of carboxylic acid components include terephthalic acid, isophthalic acid, phthalic acid, fumaric acid, maleic acid, cyclohexanedicarboxylic acid and trimellitic acid. Examples of alcohol components include bisphenol A, hydrogenated bisphenols, bisphenol A ethylene oxide adduct, bisphenol A propylene oxide adduct, glycerin, trimethyloyl propane and pentaerythritol.

The polyester resin may also be a polyester resin containing a urea group. Preferably the terminal and other carboxyl groups of the polyester resins are not capped.

To control the molecular weight of the binder resin constituting the toner particle, a crosslinking agent may also be added during polymerization of the polymerizable monomers.

Examples include ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol dimethacrylate, neopentyl glycol diacrylate, divinyl benzene, bis (4-acryloxypolyethoxyphenyl) propane, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, diacrylates of polyethylene glycol #200, #400 and #600, dipropylene glycol diacrylate, polypropylene glycol diacrylate, polyester diacrylate (MANDA, Nippon Kayaku Co., Ltd.), and these with methacrylate substituted for the acrylate.

The added amount of the crosslinking agent is preferably from 0.001 to 15.000 mass parts per 100 mass parts of the polymerizable monomers.

Release Agent

The toner may contain a release agent. In particular, a plasticization effect is easily obtained using an ester wax with a melting point of from 60° C. to 90° C. because the wax is highly compatible with the binder resin.

Examples of the ester wax include waxes having fatty acid esters as principal components, such as carnauba wax and montanic acid ester wax; those obtained by deoxidizing part or all of the oxygen component from the fatty acid ester, such as deoxidized carnauba wax; hydroxyl group-containing methyl ester compounds obtained by hydrogenation or the like of vegetable oils and fats; saturated fatty acid monoesters such as stearyl stearate and behenyl behenate; diesterified products of saturated aliphatic dicarboxylic acids and saturated fatty alcohols, such as dibehenyl sebacate, distearyl dodecanedioate and distearyl octadecanedioate; and diesterified products of saturated aliphatic diols and saturated aliphatic monocarboxylic acids, such as nonanediol dibehenate and dodecanediol distearate.

Of these waxes, it is desirable to include a bifunctional ester wax (diester) having two ester bonds in the molecular structure.

A bifunctional ester wax is an ester compound of a dihydric alcohol and an aliphatic monocarboxylic acid, or an ester compound of a divalent carboxylic acid and a fatty monoalcohol.

Specific examples of the aliphatic monocarboxylic acid include myristic acid, palmitic acid, stearic acid, arachidic acid, behenic acid, lignoceric acid, cerotic acid, montanic acid, melissic acid, oleic acid, vaccenic acid, linoleic acid and linolenic acid.

Specific examples of the fatty monoalcohol include myristyl alcohol, cetanol, stearyl alcohol, arachidyl alcohol, behenyl alcohol, tetracosanol, hexacosanol, octacosanol and triacontanol.

Specific examples of the divalent carboxylic acid include butanedioic acid (succinic acid), pentanedioic acid (glutaric acid), hexanedioic acid (adipic acid), heptanedioic acid (pimelic acid), octanedioic acid (suberic acid), nonanedioic acid (azelaic acid), decanedioic acid (sebacic acid), dodecanedioic acid, tridecaendioic acid, tetradecanedioic acid, hexadecanedioic acid, octadecanedioic acid, eicosanedioic acid, phthalic acid, isophthalic acid, terephthalic acid and the like.

Specific examples of the dihydric alcohol include ethylene glycol, propylene glycol, 1,3-propanediol, 1,4-butanediol, 1,5-pentanediol, 1,6-hexanediol, 1,10-decanediol, 1,12-dodecanediol, 1,14-tetradecanediol, 1,16-hexadecanediol, 1,18-octadecanediol, 1,20-eicosanediol, 1,30-triacontanediol, diethylene glycol, dipropylene glycol, 2,2,4-trimethyl-1,3-pentanediol, neopentyl glycol, 1,4-cyclohexane dimethanol, spiroglycol, 1,4-phenylene glycol, bisphenol A, hydrogenated bisphenol A and the like.

Other release agents that can be used include petroleum waxes such as paraffin wax, microcrystalline wax and petrolatum, and their derivatives; montanic wax and its derivatives, hydrocarbon waxes obtained by the Fischer-Tropsch method and their derivatives, polyolefin waxes such as polyethylene and polypropylene and their derivatives, natural waxes such as carnauba wax and candelilla wax and their derivatives, higher fatty alcohols, and fatty acids such as stearic acid and palmitic acid, or ester compounds thereof.

The content of the release agent is preferably from 5.0 mass parts to 20.0 mass parts per 100.0 mass parts of the binder resin.

Colorant

A colorant may also be included in the toner. The colorant is not specifically limited, and the following known colorants may be used.

Examples of yellow pigments include yellow iron oxide, Naples yellow, naphthol yellow S, Hansa yellow G, Hansa yellow OG, benzidine yellow G, benzidine yellow GR, quinoline yellow lake, permanent yellow NCG, condensed azo compounds such as tartrazine lake, isoindolinone compounds, anthraquinone compounds, azo metal complexes, methine compounds and allylamide compounds. Specific examples include:

C.I. pigment yellow 12, 13, 14, 15, 17, 62, 74, 83, 93, 94, 95, 109, 110, 111, 128, 129, 147, 155, 168 and 180.

Examples of red pigments include red iron oxide, permanent red 4R, lithol red, pyrazolone red, watching red calcium salt, lake red C, lake red D, brilliant carmine 6B, brilliant carmine 3B, eosin lake, rhodamine lake B, condensed azo compounds such as alizarin lake, diketopyrrolopyrrole compounds, anthraquinone compounds, quinacridone compounds, basic dye lake compounds, naphthol compounds, benzimidazolone compounds, thioindigo compound and perylene compounds. Specific examples include:

C.I. pigment red 2, 3, 5, 6, 7, 23, 48:2, 48:3, 48:4, 57:1, 81:1, 122, 144, 146, 166, 169, 177, 184, 185, 202, 206, 220, 221 and 254.

Examples of blue pigments include alkali blue lake, Victoria blue lake, phthalocyanine blue, metal-free phthalocyanine blue, phthalocyanine blue partial chloride, fast sky blue, copper phthalocyanine compounds such as indathrene blue BG and derivatives thereof, anthraquinone compounds and basic dye lake compounds. Specific examples include:

C.I. pigment blue 1, 7, 15, 15:1, 15:2, 15:3, 15:4, 60, 62 and 66.

Examples of black pigments include carbon black and aniline black. These colorants may be used individually, or as a mixture, or in a solid solution.

The content of the colorant is preferably from 3.0 mass parts to 15.0 mass parts per 100.0 mass parts of the binder resin.

Charge Control Agent

The toner particle may also contain a charge control agent. A known charge control agent may be used. A charge control agent that provides a rapid charging speed and can stably maintain a uniform charge quantity is especially desirable.

Examples of charge control agents for controlling the negative charge properties of the toner particle include as follows.

Examples include organic metal compounds and chelate compounds, including monoazo metal compounds, acetylacetone metal compounds, aromatic oxycarboxylic acids, aromatic dicarboxylic acids, and metal compounds of oxycarboxylic acids and dicarboxylic acids. Other examples include aromatic oxycarboxylic acids, aromatic mono- and polycarboxylic acids and their metal salts, anhydrides and esters, and phenol derivatives such as bisphenols and the like. Further examples include urea derivatives, metal-containing salicylic acid compounds, metal-containing naphthoic acid compounds, boron compounds, quaternary ammonium salts and calixarenes.

Meanwhile, examples of charge control agents for controlling the positive charge properties of the toner particle include nigrosin and nigrosin modified with fatty acid metal salts; guanidine compounds; imidazole compounds; quaternary ammonium salts such as tributylbenzylammonium-1-hydroxy-4-naphthosulfonate salt and tetrabutylammonium tetrafluoroborate, onium salts such as phosphonium salts that are analogs of these, and lake pigments of these; triphenylmethane dyes and lake pigments thereof (using phosphotungstic acid, phosphomolybdic acid, phosphotungstenmolybdic acid, tannic acid, lauric acid, gallic acid, ferricyanic acid or a ferrocyan compound or the like as the laking agent); metal salts of higher fatty acids; and resin charge control agents.

One charge control agent alone or a combination of two or more kinds may be included.

The content of the charge control agent is preferably from 0.01 mass parts to 10.00 mass parts per 100.00 mass parts of the binder resin.

The External Additive

The shape factor SF-1 of the primary particles of the external additive must not be more than 115. An external additive with an SF-1 satisfying this range is close to a perfect sphere, and due to this can roll in the nip region between the conductive member and the photosensitive drum. The shape factor SF-1 is preferably not more than 110. The lower limit is not particularly limited, but is preferably at least 100 and is more preferably at least 101.

The SF-1 of the external additive can be controlled through suitable adjustment during the reaction of the pH, temperature, and dropwise addition rate for the silane compound.

The relationship $A<Dms$ must be satisfied where A is the number-average primary particle diameter of the external additive and Dms is the arithmetic average value of the distance between adjacent walls between the domains in the conductive layer in observation of the outer surface of the conductive member.

When $A \geq Dms$, notwithstanding that the external additive rolls and is present on the matrix, the excessive size causes the generation of an unintended microgap between the photosensitive drum and the domains and image defects can end up being produced due to an unintended electrical discharge.

Dms-A is preferably 100 nm to 800 nm.

Dms is preferably from 0.15 μm (150 nm) to 2.00 μm (2000 nm) and is more preferably from 0.20 μm (200 nm) to 1.00 μm (1000 nm).

The number-average primary particle diameter A of the external additive is preferably from 30 nm to 200 nm and is more preferably from 50 nm to 150 nm.

The indentation hardness of the external additive at a load of 2 μN is preferably from 0.10 GPa to 1.50 GPa and is more preferably from 0.5 GPa to 1.0 GPa.

When the indentation hardness is at least the aforementioned lower limit, this makes it difficult for crushing to occur between the domains and the photosensitive drum, and due to this rolling is facilitated and the expected effects are readily obtained. When, on the other hand, the indentation hardness is at least the aforementioned upper limit, the external additive then has a favorable hardness and drum scratching can be suppressed.

The external additive should have the prescribed shape factor SF-1, but is not otherwise particularly limited; however, organosilicon polymer fine particles, which facilitate obtaining the desired properties, are preferred, and, from the standpoint of ease of production, polyorganosilsesquioxane fine particles are more preferred (polyalkylsilsesquioxane fine particles are still more preferred).

Various other organic fine powders and inorganic fine powders may be co-used as external additives on an optional basis for the toner particle in the toner.

Method for Manufacturing Organosilicon Polymer Fine Particle

The method for manufacturing the organosilicon polymer fine particle is not particularly limited, and for example it can be obtained by dripping a silane compound into water, hydrolyzing it with a catalyst and performing a condensation reaction, after which the resulting suspension is filtered and dried. The particle diameter can be controlled by means of the type and compounding ratio of the catalyst, the reaction initiation temperature, and the dripping time and the like.

Examples of the catalyst include, but are not limited to, acidic catalysts such as hydrochloric acid, hydrofluoric acid, sulfuric acid and nitric acid, and basic catalysts such as ammonia water, sodium hydroxide and potassium hydroxide.

The organosilicon polymer fine particle is preferably a silsesquioxane fine particle. Preferably the organosilicon polymer fine particle has a structure of alternately binding silicon atoms and oxygen atoms, and some of the silicon atoms form T3 unit structures represented by $R^aSiO_{3/2}$ (in which Ra represents a $C_{1-6}$ (preferably $C_{1-3}$, or more preferably $C_{1-2}$) alkyl group or phenyl group).

Furthermore, in $^{29}$Si-NMR measurement of the organosilicon polymer fine particle, the ratio of the area of peaks derived from silicon having a T3 unit relative to the total area of peaks derived from all silicon element contained in the organosilicon polymer is preferably from 0.90 to 1.00, or more preferably from 0.95 to 1.00.

The organosilicon compound for manufacturing the organosilicon polymer fine particle is explained here.

The organosilicon polymer is preferably a polycondensate of an organosilicon compound having a structure represented by formula (Z) below:

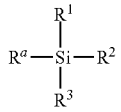

(Z)

(in formula (Z), $R^a$ represents an organic functional group, and each of $R^1$, $R^2$ and $R^3$ independently represents a halogen atom, hydroxyl group or acetoxy group, or a (preferably $C_{1-3}$) alkoxy group).

$R^a$ is an organic functional group without any particular limitations, but preferred examples include $C_{1-6}$ (preferably $C_{1-3}$, more preferably $C_{1-2}$) hydrocarbon groups (preferably alkyl groups) and aryl (preferably phenyl) groups.

Each of $R^1$, $R^2$ and $R^3$ independently represents a halogen atom, hydroxyl group, acetoxy group or alkoxy group. These are reactive groups that form crosslinked structures by hydrolysis, addition polymerization and condensation. Hydrolysis, addition polymerization and condensation of $R^1$, $R^2$ and $R^3$ can be controlled by means of the reaction temperature, reaction time, reaction solvent and pH. An organosilicon compound having three reactive groups ($R^1$, $R^2$ and $R^3$) in the molecule apart from Ra as in formula (Z) is also called a trifunctional silane.

Examples of formula (Z) include the following:

trifunctional methylsilanes such as p-styryl trimethoxysilane, methyl trimethoxysilane, methyl triethoxysilane, methyl diethoxymethoxysilane, methyl ethoxydimethoxysilane, methyl trichlorosilane, methyl methoxydichlorosilane, methyl ethoxydichlorosilane, methyl dimethoxychlorosilane, methyl methoxyethoxychlorosilane, methyl diethoxychlorosilane, methyl triacetoxysilane, methyl diacetoxymethoxysilane, methyl diacetoxyethoxysilane, methyl acetoxydimethoxysilane, methyl acetoxymethoxyethoxysilane, methyl acetoxydiethoxysilane, methyl trihydroxysilane, methyl methoxydihydroxysilane, methyl ethoxydihydroxysilane, methyl dimethoxyhydroxysilane, methyl ethoxymethoxyhydroxysilane and methyl diethoxyhydroxysilane; trifunctional ethylsilanes such as ethyl trimethoxysilane, ethyl triethoxysilane, ethyl trichlorosilane, ethyl triacetoxysilane and ethyl trihydroxysilane; trifunctional propylsilanes such as propyl trimethoxysilane, propyl triethoxysilane, propyl trichlorosilane, propyl triacetoxysilane and propyl trihydroxysilane; trifunctional butylsilanes such as butyl trimethoxysilane, butyl triethoxysilane, butyl trichlorosilane, butyl triacetoxysilane and butyl trihydroxysilane; trifunctional hexylsilanes such as hexyl trimethoxysilane, hexyl triethoxysilane, hexyl trichlorosilane, hexyl triacetoxysilane and hexyl trihydroxysilane; and trifunctional phenylsilanes such as phenyl trimethoxysilane, phenyl triethoxysilane, phenyl trichlorosilane, phenyl triacetoxysilane and phenyl trihydroxysilane. These organosilicon compounds may be used individually, or two or more kinds may be combined.

The following may also be used in combination with the organosilicon compound having the structure represented by formula (Z): organosilicon compounds having four reactive groups in the molecule (tetrafunctional silanes), organosilicon compounds having two reactive groups in the molecule (bifunctional silanes), and organosilicon compounds having one reactive group in the molecule (monofunctional silanes). Examples include:

dimethyl diethoxysilane, tetraethoxysilane, hexamethyl disilazane, 3-aminopropyl trimethoxysilane, 3-aminopropyl triethoxysilane, 3-(2-aminoethyl)aminopropyl trimethoxysilane, 3-(2-aminoethyl)aminopropyl triethoxysilane, and trifunctional vinyl silanes such as vinyl triisocyanatosilane, vinyl trimethoxysilane, vinyl triethoxysilane, vinyl diethoxymethoxysilane, vinyl ethoxydimethoxysilane, vinyl ethoxydihydroxysilane, vinyl dimethoxyhydroxysilane, vinyl ethoxymethoxyhydroxysilane and vinyl diethoxyhydroxysilane.

The content of the structure represented by formula (Z) in the monomers forming the organosilicon polymer is preferably at least 50 mol %, or more preferably at least 60 mol %.

The content of the external additive (organosilicon polymer fine particles), per 100 mass parts of the toner particle, is preferably from 0.3 mass parts to 10.0 mass parts and is more preferably from 0.5 mass parts to 8.0 mass parts.

The Process Cartridge

The process cartridge has the following features.

A process cartridge detachably provided to a main body of an electrophotographic apparatus, the process cartridge including a charging unit for charging the surface of an electrophotographic photosensitive member, and a developing apparatus for forming a toner image on the surface of the electrophotographic photosensitive member by developing an electrostatic latent image formed on the surface of the electrophotographic photosensitive member with a toner, wherein the developing unit includes a toner; and the charging unit includes a conductive member disposed to be contactable with the electrophotographic photosensitive member.

The toner and the conductive member that have been described above can be used in this process cartridge.

The process cartridge may include a frame in order to support the charging unit and the developing unit.

Figure 4:
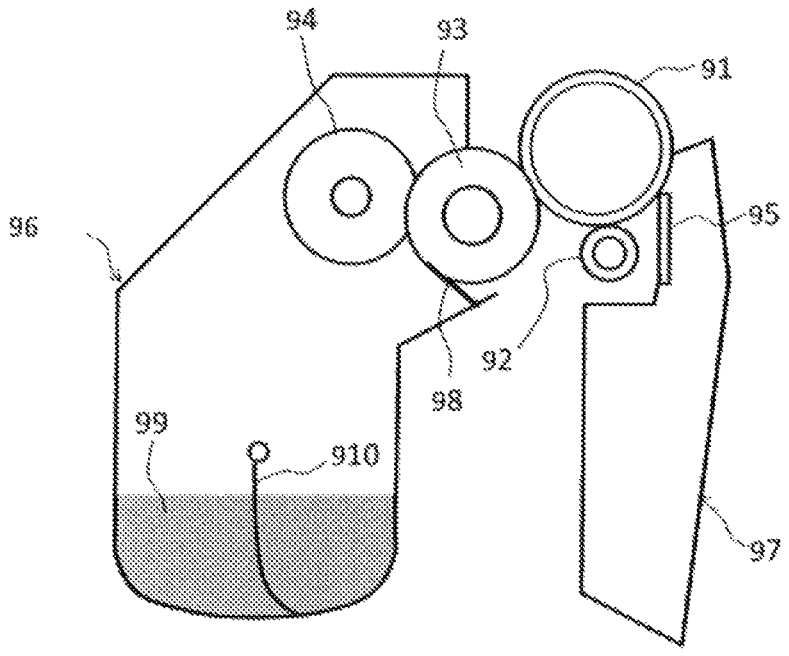
FIG. 4 is a schematic diagram of a process cartridge.

FIG. 4 is a schematic cross-sectional diagram of an electrophotographic process cartridge equipped with a conductive member as a charging roller. This process cartridge includes a developing unit and charging unit formed into a single article and is configured to be detachable from and attachable to the main body of an electrophotographic apparatus.

The developing unit is provided with at least a developing roller 93, and includes a toner 99. The developing unit may optionally include a toner supply roller 94, a toner container 96, a developing blade 98, and a stirring blade 910 formed into a single article.

The charging unit should be provided with at least a charging roller 92 and may be provided with a cleaning blade 95 and a waste toner container 97. The conductive member should be disposed to be contactable with the electrophotographic photosensitive member, and due to this the electrophotographic photosensitive member (photosensitive drum 91) may be integrated with the charging unit as a constituent element of the process cartridge or may be fixed in the main body as a constituent element of the electrophotographic apparatus.

A voltage may be applied to each of the charging roller 92, developing roller 93, toner supply roller 94, and developing blade 98.

The Electrophotographic Apparatus

The electrophotographic apparatus has the following features.

An electrophotographic apparatus including an electrophotographic photosensitive member, a charging unit for charging a surface of the electrophotographic photosensitive member, and a developing unit for forming a toner image on the surface of the electrophotographic photosensitive member by developing an electrostatic latent image formed on the surface of the electrophotographic photosensitive member with a toner, wherein the charging unit includes a conductive member disposed to be contactable with the electrophotographic photosensitive member.

The toner and the conductive member that have been described above can be used in this electrophotographic apparatus.

The electrophotographic apparatus may include an image-wise exposure unit for irradiating the surface of the electrophotographic photosensitive member with image-wise exposure light to form an electrostatic latent image on the electrophotographic photosensitive member;

a transfer unit for transferring a toner image formed on the surface of the electrophotographic photosensitive member to a recording medium; and a fixing unit for fixing, to the recording medium, the toner that has been transferred to the recording medium.

Figure 5:
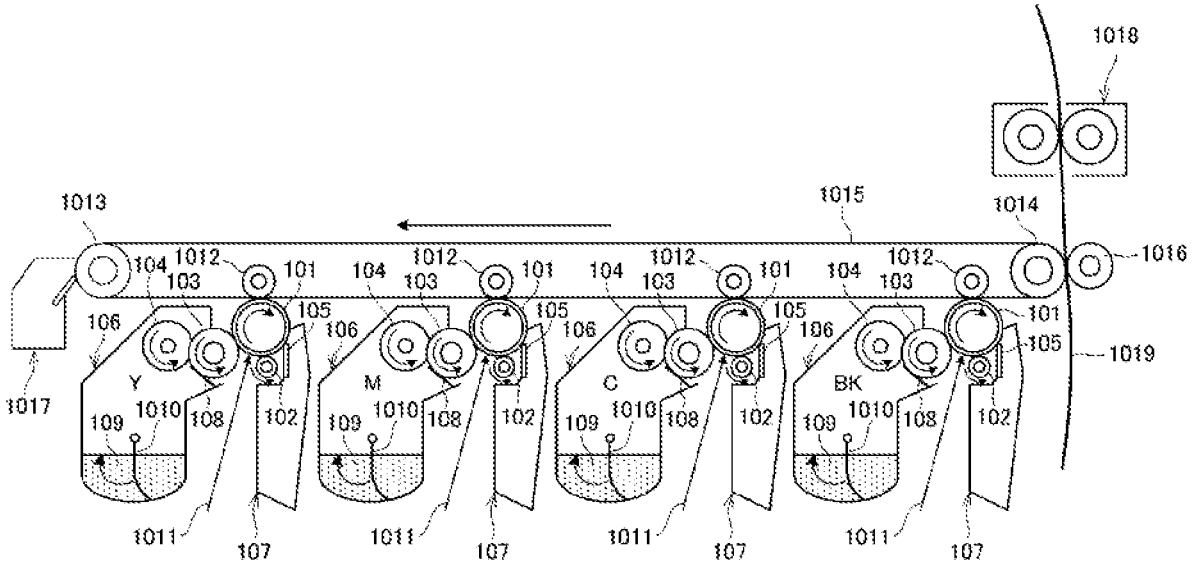
FIG. 5 is a schematic cross-sectional diagram of an electrophotographic apparatus.

FIG. 5 is a schematic component diagram of an electrophotographic apparatus that uses a conductive member as a charging roller. This electrophotographic apparatus is a color electrophotographic apparatus in which four process cartridges are detachably mounted. Toners in each of the following colors are used in the respective process cartridges: black, magenta, yellow, and cyan.

A photosensitive drum 101 rotates in the direction of the arrow and is uniformly charged by a charging roller 102, to which a voltage has been applied from a charging bias power source, and an electrostatic latent image is formed on the surface of the photosensitive drum 101 by exposure light 1011. On the other hand, a toner 109, which is stored in a toner container 106, is supplied by a stirring blade 1010 to a toner supply roller 104 and is transported onto a developing roller 103.

The toner 109 is uniformly coated onto the surface of the developing roller 103 by a developing blade 108 disposed in contact with the developing roller 103, and in combination with this charge is imparted to the toner 109 by triboelectric charging. The electrostatic latent image is visualized as a toner image by development by the application of the toner 109 transported by the developing roller 103 disposed in contact with the photosensitive drum 101.

The visualized toner image on the photosensitive drum is transferred, by a primary transfer roller 1012 to which a voltage has been applied from a primary transfer bias power source, to an intermediate transfer belt 1015, which is supported and driven by a tension roller 1013 and an intermediate transfer belt driver roller 1014. The toner image for each color is sequentially stacked to form a color image on the intermediate transfer belt.

A transfer material 1019 is fed into the apparatus by a paper feed roller and is transported to between the intermediate transfer belt 1015 and a secondary transfer roller 1016. Under the application of a voltage from a secondary transfer bias power source, the secondary transfer roller 1016 transfers the color image on the intermediate transfer belt 1015 to the transfer material 1019. The transfer material 1019 to which the color image has been transferred is subjected to a fixing process by a fixing unit 1018 and is discharged from the apparatus to complete the printing operation.

Otherwise, the untransferred toner remaining on the photosensitive drum is scraped off by a cleaning blade 105 and is held in a waste toner collection container 107, and the cleaned photosensitive drum 101 repeats the aforementioned process. In addition, untransferred toner remaining on the primary transfer belt is also scraped off by a cleaning unit 1017.

The Cartridge Set

The cartridge set has the following features.

A cartridge set including a first cartridge and a second cartridge detachably provided to a main body of an electrophotographic apparatus, wherein the first cartridge includes a charging unit for charging a surface of an electrophotographic photosensitive member and a first frame for supporting the charging unit;

the second cartridge includes a toner container that holds a toner for forming a toner image on the surface of the electrophotographic photosensitive member by developing an electrostatic latent image formed on the surface of the electrophotographic photosensitive member; and the charging unit includes a conductive member disposed to be contactable with the electrophotographic photosensitive member.

The toner and the conductive member that have been described above can be used in this cartridge set.

Since the conductive member should be disposed to be contactable with the electrophotographic photosensitive member, the first cartridge may be provided with the electrophotographic photosensitive member or the electrophotographic photosensitive member may be fixed in the main body of the electrophotographic apparatus. For example, the first cartridge may have an electrophotographic photosensitive member, a charging unit for charging the surface of the electrophotographic photosensitive member, and a first frame for supporting the electrophotographic photosensitive member and the charging unit. However, the second cartridge may be provided with the electrophotographic photosensitive member.

The first cartridge or the second cartridge may be provided with a developing unit for forming a toner image on the surface of the electrophotographic photosensitive member. The developing unit may be fixed in the main body of the electrophotographic apparatus.

The methods for measuring the various physical properties are explained below.

Identifying Organosilicon Polymer Fine Particle (Measuring Ratio of T3 Unit Structures)

The compositions and proportions of the constituent compounds of the organosilicon polymer fine particle in the toner are identified by solid pyrolysis gas chromatography/mass spectrometry (hereunder solid pyrolysis GC/MS) and NMR.

When the toner contains a silica fine particle in addition to the organosilicon polymer fine particle, 1 g of the toner is dissolved and dispersed in 31 g of chloroform in a vial. Dispersion is performed for 30 minutes with an ultrasound homogenizer to prepare a liquid dispersion.

Ultrasonic processing unit: VP-050 ultrasound homogenizer (Taitec Corporation) Microchip: Step microchip, tip diameter φ2 mm Microchip tip position: Center of glass vial and 5 mm above bottom of vial Ultrasound conditions: Intensity 30%, 30 minutes; ultrasound is applied while cooling the vial with ice water so that the temperature of the dispersion does not rise.

The dispersion is transferred to a glass tube for a swing rotor (50 mL), and centrifuged for 30 minutes at 58.33 $S^{-1}$ with a centrifuge (H-9R; Kokusan Co., Ltd.). After centrifugation, the Si content apart from the organosilicon polymer is contained in the lower layer in the glass tube. The chloroform solution of the upper layer containing the Si content derived from the organosilicon polymer is collected, and the chloroform is removed by vacuum drying (40° C./24 hours) to prepare a sample.

Using this sample or the organosilicon polymer fine particle, the abundance ratios of the constituent compounds of the organosilicon polymer fine particle and the ratio of T3 unit structures in the organosilicon polymer fine particle are measured and calculated by solid $^{29}$Si-NMR.

The types of the constituent compounds of the organosilicon polymer fine particle are analyzed by solid pyrolysis GC/MS.

The organosilicon polymer fine particle is pyrolyzed at 550° C. to 700° C., the decomposition product derived from the organosilicon polymer fine particle is measured by mass spectrometry, and the degradation peaks can then be analyzed to identify the types of constituent compounds in the organosilicon polymer fine particle.

Pyrolysis GC/MS Measurement Conditions

Pyrolyzer: JPS-700 (Japan Analytical Industry Co., Ltd.)

Pyrolysis temperature: 590° C.

GC/MS unit: Focus GC/ISQ (Thermo Fisher Scientific)

Column: HP-5MS, length 60 m, bore 0.25 mm, film thickness 0.25 μm

Injection port temperature: 200° C.

Flow pressure: 100 kPa

Split: 50 mL/min

MS ionization: EI

Ion source temperature: 200° C., mass range 45 to 650

The abundance ratios of the identified constituent compounds of the organosilicon polymer fine particle are then measured and calculated by solid $^{29}$Si-NMR. In solid $^{29}$Si-NMR, peaks are detected in different shift regions according to the structures of functional groups binding to the Si of the constituent compounds of the organosilicon polymer fine particle. Each peak position can be specified with a standard sample to specify the structure binding to the Si. The abundance ratio of each constituent compound can then be calculated from the resulting peak area. The proportion of peak areas with T3 unit structures relative to all peak areas can then be determined by calculation. The measurement conditions for solid $^{29}$Si-NMR are as follows for example.

Unit: JNM-ECX5002 (JEOL RESONANCE Inc.)

Temperature: Room temperature

Measurement method: DDMAS method, $^{29}$Si 45°

Sample tube: Zirconia 3.2 mm φ

Sample: Packed in sample tube in powder form

Sample rotation: 10 kHz

Relaxation delay: 180 s

Scan: 2000

After this measurement, the peaks of the multiple silane components having different substituents and linking groups in the organosilicon polymer are separated by curve fitting into the following X1, X2, X3 and X4 structures, and the respective peak areas are calculated.

Note that the X3 structure mentioned below corresponds to the T3 unit structure in the present invention.

X1 structure: $(Ri)(Rj)(Rk)SiO_{1/2}$ (A1)

X2 structure: $(Rg)(Rh)Si(O_{1/2})_2$ (A2)

X3 structure: $RmSi(O_{1/2})_3$ (A3)

X4 structure: $Si(O_{1/2})_4$ (A4)

X1:

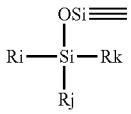

(A1)

X2:

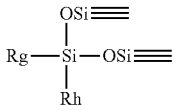

(A2)

X3:

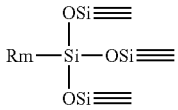

(A3)

X4:

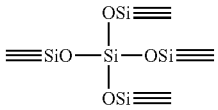

(A4)

The organic group represented by Ra above is confirmed by $^{13}$C-NMR.

$^{13}$C-NMR (Solid) Measurement Conditions

Unit: JNM-ECX500II (JEOL RESONANCE Inc.)

Sample tube: 3.2 mm φ

Sample: Packed in sample tube in powder form

Sample temperature: Room temperature

Pulse mode: CP/MAS

Measurement nuclear frequency: 123.25 MHz ($^{13}C$)
Standard substance: Adamantane (external standard: 29.5 ppm)
Sample rotation: 20 kHz
Contact time: 2 ms
Delay time: 2 s
Number of integrations: 1024

In this method, the hydrocarbon group represented by $R^a$ above is confirmed based on the presence or absence of signals attributable to methyl groups (Si—$CH_3$), ethyl groups (Si—$C_2H_5$), propyl groups (Si—$C_3H_7$), butyl groups (Si—$C_4H_9$), pentyl groups (Si—$C_5H_{11}$), hexyl groups (Si—$C_6H_{13}$) or phenyl groups (Si—$C_6H_5$) bound to silicon atoms.

Measuring Organosilicon Polymer Fine Particle in Toner

The content of organosilicon polymer fine particle in toner can be determined by the following method.

When a silicon-containing substance other than the organosilicon polymer fine particle is included in the toner, 1 g of toner is dissolved in 31 g of chloroform in a vial, and silicon-containing matter is dispersed away from the toner particle. Dispersion is performed for 30 minutes with an ultrasonic homogenizer to prepare a liquid dispersion.

Ultrasonic processing unit: VP-050 ultrasound homogenizer (Taitec Corporation)
Microchip: Step microchip, tip diameter φ2 mm
Microchip tip position: Center of glass vial and 5 mm above bottom of vial
Ultrasound conditions: Intensity 30%, 30 minutes; ultrasound is applied while cooling the vial with ice water so that the temperature of the dispersion does not rise.

The dispersion is transferred to a swing rotor glass tube (50 mL), and centrifuged for 30 minutes under conditions of 58.33 S-1 with a centrifuge (H-9R; Kokusan Co., Ltd.). After centrifugation, silica-containing material other than the organosilicon polymer fine particle is contained in the lower layer in the glass tube. The chloroform solution of the upper layer is collected, and the chloroform is removed by vacuum drying (40° C./24 hours).

This step is repeated to obtain 4 g of a dried sample. This is pelletized, and the silicon content is determined by fluorescence X-ray.

Fluorescence X-ray is performed in accordance with JIS K 0119-1969. Specifically, this is done as follows.

An "Axios" wavelength disperser fluorescence X-ray spectrometer (PANalytical) is used as the measurement unit with the accessory "SuperQ ver. 5.0L" dedicated software (PANalytical) for setting the measurement conditions and analyzing the measurement data. Rh is used for the anode of the X-ray tube and vacuum as the measurement atmosphere, and the measurement diameter (collimator mask diameter) is 27 mm.

Measurement is performed by the Omnian method in the range of elements F to U, and detection is performed with a proportional counter (PC) for light elements and a scintillation counter (SC) for heavy elements. The acceleration voltage and current value of the X-ray generator are set so as to obtain an output of 2.4 kW. For the measurement sample, 4 g of sample is placed in a dedicated aluminum pressing ring and smoothed flat, and then pressed for 60 seconds at 20 MPa with a "BRE-32" tablet compression molding machine (Maekawa Testing Machine Mfg. Co., Ltd.) to mold a pellet 2 mm thick and 39 mm in diameter.

Measurement is performed under the above conditions to identify each element based on its peak position in the resulting X-ray, and the mass ratio of each element is calculated from the count rate (unit: cps), which is the number of X-ray photons per unit time.

For the analysis, the mass ratios of all elements contained in the sample are calculated by the FP assay method, and the content of silicon in the toner is determined. In the FP assay method, the balance is set according to the binder resin of the toner.

The content of the organosilicon polymer fine particle in the toner can be calculated from the silicon content of the toner as determined by fluorescence X-ray and the content ratio of silicon in the constituent compounds.

The Number-Average Primary Particle Diameter of the External Additive

The number-average primary particle diameter of the external additive is measured using an "S-4800" scanning electron microscope (product name, Hitachi, Ltd.). Observation is carried out on the toner to which the external additive has been added; the long diameter of 100 randomly selected primary particles of the external additive is measured in a field of view that has been magnified by a maximum of 50,000×; and the number-average particle diameter is calculated. The magnification for the observation is adjusted as appropriate in accordance with the size of the external additive.

(In the Case of Measuring the Organosilicon Polymer Fine Particle)

The organosilicon polymer fine particle contained in the toner can be identified by a combination of shape observation by SEM and elemental analysis by EDS.

The toner is observed in a field enlarged to a maximum magnification of 50,000× with a scanning electron microscope (trade name: "S-4800", Hitachi, Ltd.). The microscope is focused on the toner particle surface, and the external additive is observed. Each particle of the external additive is subjected to EDS analysis to determine whether or not the analyzed particle is an organosilicon polymer fine particle based on the presence or absence of an Si element peak.

When the toner contains both an organosilicon polymer fine particle and a silica fine particle, the ratio of the elemental contents (atomic %) of Si and O (Si/O ratio) is compared with that of a standard product to identify the organosilicon polymer fine particle. Standard products of both the organosilicon polymer fine particle and silica fine particle are subjected to EDS analysis under the same conditions, to determine the respective elemental contents (atomic %) of Si and O in both. The Si/O ratio of the organosilicon polymer fine particle is given as A, and the Si/O ratio of the silica fine particle as B. Measurement conditions are selected such that A is significantly larger than B. Specifically, the standard products are measured 10 times under the same conditions, and arithmetic means are obtained for both A and B. The measurement conditions are selected so that the resulting average values yield an A/B ratio greater than 1.1.

If the Si/O ratio of particle to be distinguished is closer to A than to [(A+B)/2], the fine particle is judged to be an organosilicon polymer fine particle.

Tospearl 120A (Momentive Performance Materials Japan LLC) is used as the standard product for the organosilicon polymer fine particle, and HDK V15 (Asahi Kasei Corporation) as the standard product for the silica fine particle.

Method for Measuring the Shape Factor SF-1 of the External Additive

The shape factor SF-1 of the external additive is measured using an "S-4800" scanning electron microscope (product name, Hitachi, Ltd.). The toner to which the external additive has been added is subjected to observation, and calculation is performed as indicated below.

The magnification of the observation is adjusted as appropriate depending on the size of the external additive. The perimeter length and area of 100 randomly selected primary particles of the external additive are determined using "Image-Pro Plus5.1J" (Media Cybernetics, Inc.) image processing software in a field of view that has been magnified by a maximum of 200,000×. The SF-1 values are calculated using the formula given below, and the average value thereof is used as the SF-1.

$$SF\text{-}1=(\text{maximum length of particle})^2/\text{area of particle}\times\pi/4\times100$$

When organosilicon polymer fine particles are being measured, the organosilicon polymer fine particles can be distinguished using the aforementioned EDS analysis.

Indentation Hardness of the Organosilicon Polymer Fine Particles microhardness tester: Triboindenter TI950 (Bruker Japan KK) measurement mode: quasi-static indentation test (load control mode) indenter: Berkovich indenter (Scanned Image Acquisition Conditions)

First, in order to identify the locations of the organosilicon polymer fine particles on the toner particle, a scanned image is acquired using the following conditions.

Setpoint: 1 μN
Scan Rate: 1 Hz
Tip Velocity: 10 μm/sec (Measurement Conditions for the Microhardness Test on the Organosilicon Polymer Fine Particles on the Toner Particle)

The locations of the protruded structures are established from the scanned image that has been acquired, and the indentation test is run using the following conditions.

maximum indentation load: 2 μN
indentation time: 5 seconds
hold time: 2 seconds
unloading time: 5 seconds The indentation hardness is calculated using the load-deformation curve obtained under these conditions. The calculations are carried out using the software provided with the instrument.

When an external additive other than organosilicon polymer fine particles is contained in the toner, the organosilicon polymer fine particles are separated as follows.

1 g of the toner is dissolved in chloroform and the external additive is dispersed from the toner particle. The chloroform is then removed by vacuum drying (40° C./24 hours). The residue after removal of the chloroform is transferred to a vial; 31 g of the dispersion medium is added; and a dispersion is prepared by treatment for 30 minutes using an ultrasound homogenizer. The following, for example, can be used as the dispersion medium: a sucrose concentrate provided by the addition of 170 g of sucrose (Kishida Chemical Co., Ltd.) to 100 mL of deionized water and dissolving while heating on a water bath.

ultrasound treatment instrument: VP-050 ultrasound homogenizer (TIETECH Co., Ltd.)
microchip: stepped microchip, 2 mm ϕ end diameter
position of microchip end: center of glass vial, 5 mm height from bottom of vial ultrasound conditions: 30% intensity, 30 minutes. During this treatment, the ultrasound is applied while cooling the vial with ice water to prevent the temperature of the dispersion from rising.

The dispersion is transferred to a glass tube (50 mL) for swing rotor service, and centrifugal separation is carried out using a centrifugal separator (H-9R, Kokusan Co., Ltd.) and conditions of 58.33 $S^{-1}$ and 30 minutes. After the centrifugal separation, external additive other than the organosilicon polymer finer particles is contained in the lower layer in the glass tube. The aqueous solution upper layer is recovered and filtered. The residue provided by the filtration is washed with distilled water and then vacuum dried (40° C./24 hours). After drying, the recovered sample is ground with a mortar to obtain a powder sample of the organosilicon polymer fine particles.

A scanned image is acquired of the resulting powder sample of organosilicon polymer fine particles using the scanned image acquisition conditions given above, and the locations of single organosilicon polymer fine particles are identified. Single organosilicon polymer fine particles can be discriminated by identifying the particle diameter from the obtained scanned image and selecting the desired particle diameter.

The location of an organosilicon polymer fine particle is identified from the obtained scanned image and an indentation test is carried out using the same conditions as the measurement conditions in the previously described microhardness test. The indentation hardness is determined using the load-deformation curve yielded by the indentation test. The calculations are performed using the software provided with the instrument.

EXAMPLES

The invention is explained in more detail below based on examples and comparative examples, but the invention is in no way limited to these. Unless otherwise specified, parts in the examples are based on mass.

Toner particle manufacturing examples are explained.

Preparation of Binder Resin Particle Dispersion 89.5 parts of styrene, 9.2 parts of butyl acrylate, 1.3 parts of acrylic acid and 3.2 parts of n-lauryl mercaptane were mixed and dissolved. An aqueous solution of 1.5 parts of Neogen RK (DKS Co., Ltd.) in 150 parts of ion-exchange water was added and dispersed in this mixed solution.

This was then gently stirred for 10 minutes as an aqueous solution of 0.3 parts of potassium persulfate mixed with 10 parts of ion-exchange water was added.

After nitrogen purging, emulsion polymerization was performed for 6 hours at 70° C. After completion of polymerization, the reaction solution was cooled to room temperature, and ion-exchange water was added to obtain a binder resin particle dispersion with a volume-based median particle diameter of 0.2 μm and a solids concentration of 12.5 mass %.

Preparation of Release Agent Dispersion 100 parts of a release agent (behenyl behenate, melting point: 72.1° C.) and 15 parts of Neogen RK were mixed with 385 parts of ion-exchange water, and dispersed for about 1 hour with a JN100 wet jet mill (Jokoh Co., Ltd.) to obtain a release agent dispersion. The solids concentration of the release agent dispersion was 20 mass %.

Preparation of Colorant Dispersion 100 parts of carbon black "Nipex35 (Orion Engineered Carbons)" as a colorant and 15 parts of Neogen RK were mixed with 885 parts of ion-exchange water, and dispersed for about 1 hour in a JN100 wet jet mill to obtain a colorant dispersion.

Preparation of Toner Particle 265 parts of the binder resin particle dispersion, 10 parts of the release agent dispersion and 10 parts of the colorant dispersion were dispersed with a homogenizer (IKA Japan K.K.: Ultra-Turrax T50).

The temperature inside the vessel was adjusted to 30° C. under stirring, and 1 mol/L hydrochloric acid was added to adjust the pH to 5.0. This was left for 3 minutes before initiating temperature rise, and the temperature was raised to 50° C. to produce aggregate particles. The particle diameter of the aggregate particles was measured under these conditions with a "Multisizer 3 Coulter Counter" (registered trademark, Beckman Coulter, Inc.). Once the weight-average particle diameter reached 6.2 μm, 1 mol/L sodium hydroxide aqueous solution was added to adjust the pH to 8.0 and arrest particle growth.

The temperature was then raised to 95° C. to fuse and spheroidize the aggregate particles. Temperature lowering was initiated when the average circularity reached 0.980, and the temperature was lowered to 30° C. to obtain a toner particle dispersion 1.

Hydrochloric acid was added to adjust the pH of the resulting toner particle dispersion 1 to 1.5 or less, and the dispersion was stirred for 1 hour, left standing, and then subjected to solid-liquid separation in a pressure filter to obtain a toner cake.

This was made into a slurry with ion-exchange water, re-dispersed, and subjected to solid-liquid separation in the previous filter unit. Re-slurrying and solid-liquid separation were repeated until the electrical conductivity of the filtrate was not more than 5.0 μS/cm, to perform final solid-liquid separation and obtain a toner cake.

The resulting toner cake was dried with a Flash Jet air dryer (Seishin Enterprise Co., Ltd.). The drying conditions were a blowing temperature of 90° C. and a dryer outlet temperature of 40° C., with the toner cake supply speed adjusted according to the moisture content of the toner cake so that the outlet temperature did not deviate from 40° C. Fine and coarse powder was cut with a multi-division classifier using the Coanda effect, to obtain a toner particle. The toner particle had a weight-average particle diameter (D4) of 6.3 μm, an average circularity of 0.980, and a glass transition temperature (Tg) of 57° C.

Using a Coanda effect-based multi-grade classifier, the fines and coarse particles are cut from the toner particle yielded by the above-described method to obtain a toner particle 1.

Manufacturing examples of the organosilicon polymer fine particle are explained.

Manufacturing Example of Organosilicon Polymer Fine Particle 1

Step 1

360 parts of water were placed in a reactor equipped with a thermometer and a stirrer, and 15 parts of 5.0 mass % hydrochloric acid were added to obtain a uniform solution. This was stirred at 25° C. as 136 parts of methyl trimethoxysilane were added, and the mixture was stirred for 5 hours and then filtered to obtain a clear reaction solution containing a silanol compound or a partial condensate thereof.

Step 2

540 parts of water were placed in a reactor equipped with a thermometer, a stirrer and a dripping mechanism, and 17 parts of 10.0 mass % ammonia water were added to obtain a uniform solution. This was stirred at 35° C. as 100 parts of the reaction solution obtained in Step 1 were dripped in over the course of 0.5 hours, and then stirred for 6 hours to obtain a suspension. The resulting suspension was centrifuged to precipitate and remove fine particles, and then dried for 24 hours in a drier at 200° C. to obtain an organosilicon polymer fine particle 1.

The resulting organosilicon polymer fine particle 1 has the number-average particle diameter of the primary particles measured by scanning electron microscope of 100 nm, and has the shape factor SF-1 of 105.

Manufacturing Examples of Organosilicon Polymer Fine Particles 2 to 9

Organosilicon polymer fine particles 2 to 9 were obtained as in the manufacturing example of the organosilicon polymer fine particle except that the silane compound, reaction initiation temperature, added amount of the catalyst, and dripping time were changed as shown in Tables 1-1 and 1-2. The physical properties are shown in Tables 1-1 and 1-2.

TABLE 1-1

| | First step | | | | | | |
|---|---|---|---|---|---|---|---|
| Organosilicon polymer fine | Water | Hydrochloric acid | Reaction temperature | Silane compound A | | Silane compound B | |
| particle No. | Parts | Parts | ° C. | Name | Parts | Name | Parts |
| 1 | 360 | 15 | 25 | Methyltrimethoxysilane | 136 | — | — |
| 2 | 360 | 15 | 25 | Methyltrimethoxysilane | 133 | — | — |
| 3 | 360 | 18.5 | 25 | Methyltrimethoxysilane | 136 | — | — |
| 4 | 360 | 20 | 25 | Ethyltriethoxysilane | 182.4 | Triethylethoxysilane | 8 |
| 5 | 60 | 15 | 25 | Methyltrimethoxysilane | 7.5 | Tetramethoxysilane | 128.2 |
| 6 | 360 | 15 | 25 | Methyltrimethoxysilane | 20.9 | Tetramethoxysilane | 112.9 |
| 7 | 360 | 15 | 25 | Dimethyldimethoxysilane | 64.7 | Methyltrimethoxysilane | 71 |
| 8 | 360 | 15 | 25 | Dimethyldimethoxysilane | 77.5 | Methyltrimethoxysilane | 58.2 |
| 9 | 360 | 15 | 25 | Methyltrimethoxysilane | 133 | — | — |

TABLE 1-2

| | Second step | | | | | Number- | | |
|---|---|---|---|---|---|---|---|---|
| Organosilicon polymer fine particle No. | Reaction solution yielded by first step Parts | Water Parts | Aqueous ammonia Parts | Reaction start temperature ° C. | Dropwise addition time hour | average particle diameter nm | SF-1 | Indentation hardness (GPa) |
| 1 | 100 | 540 | 17 | 35 | 0.5 | 100 | 105 | 0.6 |
| 2 | 100 | 585 | 17 | 35 | 0.5 | 100 | 114 | 0.6 |
| 3 | 100 | 540 | 20 | 30 | 0.29 | 200 | 110 | 0.7 |

TABLE 1-2-continued

| Organosilicon polymer fine particle No. | Second step: Reaction solution yielded by first step Parts | Water Parts | Aqueous ammonia Parts | Reaction start temperature ° C. | Dropwise addition time hour | Number-average particle diameter nm | SF-1 | Indentation hardness (GPa) |
|---|---|---|---|---|---|---|---|---|
| 4 | 100 | 540 | 21 | 30 | 0.25 | 250 | 110 | 0.6 |
| 5 | 100 | 540 | 17 | 35 | 0.5 | 100 | 107 | 1.6 |
| 6 | 100 | 540 | 17 | 35 | 0.5 | 100 | 101 | 1.48 |
| 7 | 100 | 540 | 17 | 35 | 0.5 | 100 | 105 | 0.1 |
| 8 | 100 | 540 | 17 | 35 | 0.5 | 100 | 105 | 0.05 |
| 9 | 100 | 645 | 17 | 35 | 0.5 | 100 | 120 | 0.6 |

Examples of toner production are described in the following.

Toner 1 Production Example 100 parts of the toner particle 1 yielded by the above-described method and 1.0 parts of the organosilicon polymer fine particle 1 were introduced into an FM mixer (Model FM10C, Nippon Coke & Engineering Co., Ltd.) having 7° C. water being injected into the jacket. After the water temperature in the jacket had stabilized at 7° C.±1° C., a toner mixture 1 was obtained by mixing for 5 minutes at a peripheral velocity of 38 m/sec for the rotating blades. During this, the amount of water passed through the jacket was adjusted as appropriate so the temperature within the tank of the FM mixer did not exceed 25° C.

The obtained toner mixture 1 was sieved on a mesh having an aperture of 75 μm to obtain toner 1.

Toners 2 to 9 and Comparative Toner 1 Production Example

Toners 2 to 8 were obtained proceeding as in the Toner 1 Production Example, but changing the organosilicon polymer fine particle 1 to organosilicon polymer fine particle 2 to 8, respectively.

Toner 9 was obtained proceeding as in the Toner 1 Production Example, but changing the organosilicon polymer fine particle 1 to a sol-gel silica (X24-9600A, Shin-Etsu Chemical Co., Ltd.).

Comparative toner 1 was obtained proceeding as in the Toner 1 Production Example, but changing the organosilicon polymer fine particle 1 to organosilicon polymer fine particle 9.

Conductive Member 1 Production Example

[1-1. Preparation of Domain-Forming Rubber Mixture (CMB)]

A CMB was obtained by mixing the materials indicated in Table 2 at the amounts of incorporation given in Table 2, using a 6-liter pressure kneader (product name: TD6-15MDX, Toshin Co., Ltd.). The mixing conditions were a fill ratio of 70 volume %, a blade rotation rate of 30 rpm, and 30 minutes.

TABLE 2

| | Ingredient name | Amount of incorporation (parts) |
|---|---|---|
| Starting rubber | Styrene-butadiene rubber (product name: TUFDENE 1000, Asahi Kasei Corporation) | 100 |
| Electronic conducting agent | Carbon black (product name: TOKABLACK #5500, Tokai Carbon Co., Ltd.) | 60 |
| Vulcanization co-accelerator | Zinc oxide (product name: Zinc White, Sakai Chemical Industry Co., Ltd.) | 5 |

TABLE 2-continued

| | Ingredient name | Amount of incorporation (parts) |
|---|---|---|
| Processing aid | Zinc stearate (product name: SZ-2000, Sakai Chemical Industry Co., Ltd.) | 2 |

1-2. Preparation of Matrix-Forming Rubber Mixture (MRC)

An MRC was obtained by mixing the materials indicated in Table 3 at the amounts of incorporation given in Table 3, using a 6-liter pressure kneader (product name: TD6-15MDX, Toshin Co., Ltd.). The mixing conditions were a fill ratio of 70 volume %, a blade rotation rate of 30 rpm, and 16 minutes.

TABLE 3

| | Ingredient name | Amount of incorporation (parts) |
|---|---|---|
| Starting rubber | Butyl rubber (product name: JSR Butyl 065, JSR Corporation) | 100 |
| Filler | Calcium carbonate (product name: NANOX #30, Maruo Calcium Co., Ltd.) | 70 |
| Vulcanization co-accelerator | Zinc oxide (product name: Zinc White, Sakai Chemical Industry Co., Ltd.) | 7 |
| Processing aid | Zinc stearate (product name: SZ-2000, Sakai Chemical Industry Co., Ltd.) | 2.8 |

1-3. Preparation of Unvulcanized Rubber Mixture for Conductive Layer Formation

The CMB and the MRC obtained as described above were mixed at the amounts of incorporation given in Table 4 using a 6-liter pressure kneader (product name: TD6-15MDX, Toshin Co., Ltd.). The mixing conditions were a fill ratio of 70 volume %, a blade rotation rate of 30 rpm, and 20 minutes.

TABLE 4

| | Ingredient name | Amount of incorporation (parts) |
|---|---|---|
| Starting rubber | Domain-forming rubber mixture | 25 |
| Starting rubber | Matrix-forming rubber mixture | 75 |

The vulcanizing agent and vulcanization accelerator indicated in Table 5 were then added in the amounts of incorporation indicated in Table 5 to 100 parts of the CMB+MRC mixture, and mixing was carried out using an open roll with a 12-inch (0.30 m) roll diameter to prepare a rubber mixture for conductive layer formation.

With regard to the mixing conditions, the front roll rotation rate was 10 rpm, the back roll rotation rate was 8 rpm, the roll gap was 2 mm, and turn buck was performed right and left a total of 20 times; this was followed by 10 thin passes on a roll gap of 0.5 mm.

TABLE 5

| | Ingredient name | Amount of incorporation (parts) |
|---|---|---|
| Vulcanizing agent | Sulfur (product name: SULFAX PMC, Tsurumi Chemical Industry Co., Ltd.) | 3 |
| Vulcanization accelerator | Tetramethylthiuram disulfide (product name: TT, Ouchi Shinko Chemical Industrial Co., Ltd.) | 3 |

2. Production of the Conductive Member 2-1. Preparation of a Support Having a Conductive Outer Surface A round bar having a total length of 252 mm and an outer diameter of 6 mm, and having an electroless nickel plating treatment executed on a stainless steel (SUS) surface, was prepared as the support having a conductive outer surface.

2-2. Molding the Conductive Layer

A die with an inner diameter of 12.5 mm was mounted at the tip of a crosshead extruder having a feed mechanism for the support and a discharge mechanism for the unvulcanized rubber roller, and the temperature of the extruder and crosshead was adjusted to 80° C. and the support transport speed was adjusted to 60 mm/sec. Operating under these conditions, the rubber mixture for conductive layer formation was fed from the extruder and the outer circumference of the support was coated in the crosshead with this rubber mixture for conductive layer formation to yield an unvulcanized rubber roller.

The unvulcanized rubber roller was then introduced into a 160° C. convection vulcanization oven and the rubber mixture for conductive layer formation was vulcanized by heating for 60 minutes to obtain a roller having a conductive layer formed on the outer circumference of the support. 10 mm was then cut off from each of the two ends of the conductive layer to provide a length of 231 mm for the longitudinal direction of the conductive layer portion.

Finally, the surface of the conductive layer was ground using a rotary grinder. This yielded a crowned conductive member 1 having a diameter at the center of 8.5 mm and a diameter of 8.44 mm at each of the positions 90 mm toward each of the ends from the center.

The methods for measuring the properties pertaining to the conductive member are as follows.

Confirmation of a Matrix-Domain Structure

The presence/absence of the formation of a matrix-domain structure in the conductive layer of the conductive member is checked using the following method.

Using a razor, a section (thickness=500 μm) is cut out so as to enable the cross section orthogonal to the longitudinal direction of the conductive layer of the conductive member to be observed. Platinum vapor deposition is then carried out and a cross-sectional image is photographed using a scanning electron microscope (SEM) (product name: S-4800, Hitachi High-Technologies Corporation) and a magnification of 1000×.

Figure 2:
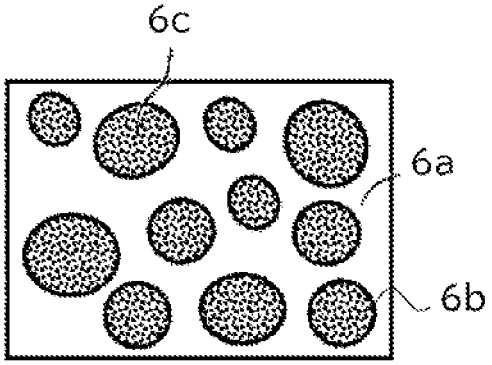
FIG. 2 is an enlarged cross-sectional diagram of a conductive layer.

A matrix-domain structure observed in the section from the conductive layer presents a morphology in which, in the cross-sectional image, a plurality of domains 6*b* are dispersed in a matrix 6*a* and the domains are present in an independent state without connection to each other, as in FIG. 2. 6*c* is an electronic conducting agent. The matrix, on the other hand, resides in a state that is continuous within the image with the domains being partitioned off by the matrix.

In order to quantify the obtained photographed image, a 256-gradation monochrome image is obtained by carrying out 8-bit grey scale conversion using image processing software (product name: Image-Pro Plus, Media Cybernetics, Inc.) on the fracture surface image yielded by the SEM observation. White/black reversal processing is then carried out on the image so the domains in the fracture surface become white, followed by generation of the binarized image with the binarization threshold being set based on the algorithm of Otsu's adaptive thresholding method for the brightness distribution of images.

Using the count function on this binarized image, and operating in a 50 μm-square region, the number percentage K is calculated for the domains that, as noted above, are isolated without connection between domains, with reference to the total number of domains that do not have a contact point with the enclosure lines for the binarized image.

Specifically, the count function of the image processing software is set to not count domains that have a contact point with the enclosure lines for the edges in the four directions of the binarized image.

The arithmetic-mean value (number %) for K is calculated by carrying out this measurement on the aforementioned sections prepared at a total of 20 points, as provided by randomly selecting 1 point from each of the regions obtained by dividing the conductive layer of the conductive member into 5 equal portions in the longitudinal direction and dividing the circumferential direction into 4 equal portions.

A matrix-domain structure is scored as being "present" when the arithmetic-mean value of K (number %) is equal to or greater than 80, and is scored as being "absent" when the arithmetic-mean value of K (number %) is less than 80.

Measurement of the Volume Resistivity R1 of the Matrix

The volume resistivity R1 of the matrix can be measured, for example, by excising, from the conductive layer, a thin section of prescribed thickness (for example, 1 μm) that contains the matrix-domain structure and bringing the microprobe of a scanning probe microscope (SPM) or atomic force microscope (AFM) into contact with the matrix in this thin section.

With regard to the excision of the thin section from the elastic layer, and, for example, as shown in FIG. 3B letting the X axis be the longitudinal direction of the conductive member, the Z axis be the thickness direction of the conductive layer, and the Y axis be its circumferential direction, the thin section is excised so as to contain at least a portion of a plane parallel to the YZ plane (for example, 83*a*, 83*b*, 83*c*), which is orthogonal to the axial direction of the conductive member. Excision can be carried out, for example, using a sharp razor, a microtome, or a focused ion beam technique (FIB).

The volume resistivity is measured by grounding one side of the thin section that has been excised from the conductive layer. The microprobe of a scanning probe microscope (SPM) or atomic force microscope (AFM) is brought into contact with the matrix part on the surface of the side opposite from the ground side of the thin section; a 50 V DC voltage is applied for 5 seconds; the arithmetic-mean value is calculated from the values measured for the ground current value for the 5 seconds; and the electrical resistance value is calculated by dividing the applied voltage by this calculated value. Finally, the resistance value is converted to the volume resistivity using the film thickness of the thin section. The SPM or AFM can also be used to measure the film thickness of the thin section at the same time as measurement of the resistance value.

For a column-shaped charging member, the value of the volume resistivity R1 of the matrix is determined, for example, by excising one thin section sample from each of the regions obtained by dividing the conductive layer into four parts in the circumferential and 5 parts in the longitudinal direction; obtaining the measurement values described above; and calculating the arithmetic-mean value of the volume resistivities for the total of 20 samples.

In the present examples, first a 1 μm-thick thin section was excised from the conductive layer of the conductive member at a slicing temperature of −100° C. using a microtome (product name: Leica EMFCS, Leica Microsystems GmbH). Using the X axis for the longitudinal direction of the conductive member, the Z axis for the thickness direction of the conductive layer, and the Y axis for its circumferential direction, as shown in FIG. 3B, excision was performed such that the thin section contained at least a portion of the YZ plane (for example, 83*a*, 83*b*, 83*c*), which is orthogonal with respect to the axial direction of the conductive member.

Operating in an environment having a temperature of 23° C. and a humidity of 50%, one side of the thin section (also referred to hereafter as the "ground side") was grounded on a metal plate, and the cantilever of a scanning probe microscope (SPM) (product name: Q-Scope 250, Quesant Instrument Corporation) was brought into contact at a location corresponding to the matrix on the side (also referred to hereafter as the "measurement side") opposite from the ground side of the thin section, and where domains were not present between the measurement side and ground side. A voltage of 50 V was then applied to the cantilever for 5 seconds; the current value was measured; and the 5-second arithmetic-mean value was calculated.

The surface profile of the section subjected to measurement was observed with the SPM and the thickness of the measurement location was calculated from the obtained height profile. In addition, the depressed portion area of the cantilever contact region was calculated from the results of observation of the surface profile. The volume resistivity was calculated from this thickness and this depressed portion area.

With regard to the thin sections, the aforementioned measurement was performed on sections prepared at a total of 20 points, as provided by randomly selecting 1 point from each of the regions obtained by dividing the conductive layer of the conductive member into 5 equal portions in the longitudinal direction and dividing the circumferential direction into 4 equal portions. The average value was used as the volume resistivity R1 of the matrix.

The scanning probe microscope (SPM) (product name: Q-Scope 250, Quesant Instrument Corporation) was operated in contact mode.

Measurement of the Volume Resistivity R2 of the Domains

The volume resistivity R2 of the domains is measured by the same method as for measurement of the matrix volume resistivity R1 as described above, but carrying out the measurement at a location corresponding to a domain in the ultrathin section and changing the measurement voltage to 1 V.

In the present examples, R2 was calculated using the same method as above (measurement of the matrix volume resistivity R1), but changing the voltage applied during measurement of the current value to 1 V and changing the location of cantilever contact on the measurement side to a location corresponding to a domain, and where the matrix was not present between the measurement side and ground side.

Measurement of Martens Hardness

The Martens hardness is measured using a microhardness tester (product name: PICODENTER HM500, Helmut Fischer GmbH). The "WIN-HCU" (product name) provided with this surface coating property tester is used as the software. The Martens hardness is a property value determined by pressing an indenter into the measurement target while applying a load, and is given by (test load)/(surface area of indenter under the test load) ($N/mm^2$).

The indenter, e.g., a four-sided pyramid, is pressed into the measurement target while applying a relatively small specified test load; the surface area contacted by the indenter is determined from the indention depth when a prescribed indention depth has been achieved; and the universal hardness is determined using the formula given below. The hardness for indention at a load of 1 mN is used in the present invention.

The measurement is carried out based on ISO 14577 using a surface coating property tester (product name: PICODENTER HM500). Ten locations randomly selected in the central area of the conductive member are used as the measurement points, and the arithmetic average value of the Martens hardness measurements is used as the measurement value for the developer carrying member. The measurement conditions are as follows:

- measurement indenter: four-sided pyramid (136° angle, Berkovich type);
- indenter material: diamond;
- measurement environment: temperature of 23° C., relative humidity of 50%;
- loading rate and unloading rate: 1 mN/50 sec;
- maximum indention load: 1 mN.

The load-hardness curve is measured by applying the load at the rate given above in the conditions, and the Martens hardness when an indentation depth of 0.1 μm has been reached is calculated using the following formula.

$$\text{Martens hardness } HM(\text{N/mm}^2)=F(\text{N})/\text{surface area } (\text{mm}^2) \text{ of the indenter under the test load}$$

In the formula, F refers to force and t refers to time.

$$\text{indentation Young's modulus } E(\text{Pa})=(1-vi^2)/Ei+(1-vs^2)/Es$$

Ei is the Young's modulus of the indenter; vi is the Poisson's ratio of the indenter; and vs is the Poisson's ratio of the conductive member.

Measurement of Martens Hardness of Matrix Region and Martens Hardness of Domain Region The Martens hardness of the matrix region and the domain region is specifically measured as follows. First, a measurement sample containing the outer surface of the conductive member is sliced, using a razor, from the conductive member that is the measurement target. The measurement sample is excised so as to have a length of 2 mm in both the circumferential direction and longitudinal direction of the conductive member and to have a thickness of 500 μm in the thickness direction from the outer surface of the conductive member.

The resulting measurement sample is placed in the microhardness tester so as to enable observation of the observation surface of the measurement sample, which corresponds to the outer surface of the conductive member. Observation of the observation surface is carried out with the microscope (50× magnification) attached to the microhardness tester, and 10 points, in each case separated by at least 0.1 μm from any domain margin, are randomly selected from the matrix region. The tip of the measurement indenter is brought into contact with each of these 10 points and the Martens hardness is measured using the conditions given above. The arithmetic average value of the measurement values obtained at the 10 points is used as the Martens hardness G1 of the matrix region.

Operating in the same manner, 10 domains are randomly selected during observation of the observation surface of the measurement sample, and in each case the measurement indenter is brought into contact with the position of the geometric center on the plane of the domain and the Martens hardness is measured using the conditions given above. The arithmetic average value of the resulting 10 measurement values is used as the Martens hardness G2 of the domain region.

The size relationship between the hardness of the domain region and the hardness of the matrix region is evaluated by comparing the thusly obtained values for the Martens hardness of the domain region and the Martens hardness of the matrix region.

Measurement of the Circle-Equivalent Diameter D of Domains Observed from the Cross Section of the Conductive Layer The circle-equivalent diameter D of the domains is determined as follows.

Using L for the length in the longitudinal direction of the conductive layer and T for the thickness of the conductive layer, 1 μm-thick samples, having sides as represented by cross sections in the thickness direction (83*a*, 83*b*, 83*c*) of the conductive layer as shown in FIG. 3B, are sliced using a microtome (product name: Leica EMFCS, Leica Microsystems GmbH) from three locations, i.e., the center in the longitudinal direction of the conductive layer and at L/4 toward the center from either end of the conductive layer.

For each of the obtained three samples, platinum vapor deposition is performed on the cross section of the thickness direction of the conductive layer. Operating on the platinum vapor-deposited surface of each sample, a photograph is taken at 5000× using a scanning electron microscope (SEM) (product name: S-4800, Hitachi High-Technologies Corporation) at three randomly selected locations within the thickness region that is a depth of 0.1 T to 0.9 T from the outer surface of the conductive layer.

Using image processing software (product name: Image-Pro Plus, Media Cybernetics, Inc.), each of the obtained nine photographed images is subjected to binarization and quantification using the count function and the arithmetic-mean value S of the area of the domains contained in each of the photographed images is calculated.

The circle-equivalent domain diameter ($=(4S/\pi)^{0.5}$) is then calculated from the calculated arithmetic-mean value S of the domain area for each of the photographed images. The arithmetic mean value of the circle-equivalent domain diameter for each photographed image is subsequently calculated to obtain the circle-equivalent diameter D of the domains observed from the cross section of the conductive layer of the conductive member that is the measurement target.

Measurement of the Particle Size Distribution of the Domains

In order to evaluate the uniformity of the circle-equivalent diameter D of the domains, the particle size distribution of the domains is measured proceeding as follows. First, binarized images are obtained using image processing software (product name: Image-Pro Plus, Media Cybernetics, Inc.) from the 5,000× observed images obtained using a scanning electron microscope (product name: S-4800, Hitachi High-Technologies Corporation) in the above-described measurement of the circle-equivalent diameter D of the domains. Then, using the count function of the image processing software, the average value D and the standard deviation ad are calculated for the domain population in the binarized image, and σd/D, which is a metric of the particle size distribution, is subsequently calculated.

For the measurement of the σd/D particle size distribution of the domain diameters, and using L for the length in the longitudinal direction of the conductive layer and T for the thickness of the conductive layer, cross sections in the thickness direction of the conductive layer, as shown in FIG. 3B, are taken at three locations, i.e., the center in the longitudinal direction of the conductive layer and at L/4 toward the center from either end of the conductive layer. Operating at a total of 9 locations, i.e., 3 randomly selected locations in the thickness region at a depth of 0.1 T to 0.9 T from the outer surface of the conductive layer, in each of the 3 sections obtained at the aforementioned 3 measurement locations, a 50 μm-square region is extracted as the analysis image; the measurement is performed; and the arithmetic-mean value for the 9 locations is calculated.

Measurement of the Interdomain Distance Dm Observed from the Cross Section of the Conductive Layer Using L for the length in the longitudinal direction of the conductive layer and T for the thickness of the conductive layer, samples, having sides as represented by the cross sections in the thickness direction (83*a*, 83*b*, 83*c*) of the conductive layer as shown in FIG. 3B, are taken from three locations, i.e., the center in the longitudinal direction of the conductive layer and at L/4 toward the center from either end of the conductive layer.

For each of the obtained three samples, a 50 μm-square analysis region is placed, on the surface presenting the cross section in the thickness direction of the conductive layer, at three randomly selected locations in the thickness region from a depth of 0.1 T to 0.9 T from the outer surface of the conductive layer. These three analysis regions are photographed at a magnification of 5000× using a scanning electron microscope (product name: S-4800, Hitachi High-Technologies Corporation). Each of the obtained total of 9 photographed images is binarized using image processing software (product name: LUZEX, Nireco Corporation).

The binarization procedure is carried out as follows. 8-bit grey scale conversion is performed on the photographed image to obtain a 256-gradation monochrome image. White/black reversal processing is carried out on the image so the domains in the photographed image become white, and binarization is performed to obtain a binarized image of the photographed image. For each of the 9 binarized images, the distances between the domain wall surfaces are then calculated, and the arithmetic-mean value of these is calculated. This is designated Dm. The distance between the wall surfaces is the distance between the wall surfaces of domains that are nearest to each other (shortest distance), and can be determined by setting the measurement parameters in the image processing software to the distance between adjacent wall surfaces.

Measurement of the Uniformity of the Interdomain Distance Dm

The standard deviation om of the interdomain distance is calculated from the distribution of the distance between the domain wall surfaces obtained in the procedure described above for measuring the interdomain distance Dm, and the variation coefficient σm/Dm, with is a metric of the uniformity of the interdomain distance, is calculated.

The Circle-Equivalent Diameter Ds of the Domains Observed from the Outer Surface of the Conductive Layer The circle-equivalent diameter Ds of the domains observed from the outer surface of the conductive layer is measured as follows.

A sample containing the outer surface of the conductive layer is excised using a microtome (product name: Leica EMFCS, Leica Microsystems GmbH) at three locations, i.e., the center in the longitudinal direction of the conductive layer and at L/4 toward the center from either end of the conductive layer where L is the length in the longitudinal direction of the conductive layer. The sample thickness is 1 μm.

Platinum vapor deposition is performed on the sample surface that corresponds to the outer surface of the conductive layer. Three locations are randomly selected on the platinum vapor-deposited surface of the sample and are photographed at 5000× using a scanning electron microscope (SEM) (product name: S-4800, Hitachi High-Technologies Corporation). Using image processing software (product name: Image-Pro Plus, Media Cybernetics, Inc.), each of the obtained total of 9 photographed images is subjected to binarization and quantification using the count function, and the arithmetic-mean value Ss of the planar area of the domains present in each of the photographed images is calculated.

The circle-equivalent domain diameter ($=(4S/\pi)^{0.5}$) is then calculated from the calculated arithmetic-mean value Ss of the domain planar area for each of the photographed images. The arithmetic-mean value of the circle-equivalent domain diameter for each photographed image is then calculated to obtain the circle-equivalent diameter Ds of the domains in observation of the conductive member that is the measurement target from the outer surface.

Measurement of Distance Dms between Adjacent Walls of Domains Observed from Outer Surface of Conductive Member Defining L as the length of the conductive layer in the longitudinal direction and T as the thickness of the conductive layer, a sample is excised using a razor so as to contain the outer surface of the conductive member, at three locations, i.e., the center of the conductive layer in the longitudinal direction and at L/4 toward the center from each end of the conductive layer. The sample size is 2 mm in the circumferential direction of the conductive member and 2 mm in the longitudinal direction of the conductive member, and the thickness T of the conductive member is used for the thickness.

For each of the obtained three samples, a 50 μm-square analysis region is placed at three randomly selected locations on the side corresponding to the outer surface of the conductive member, and these three analysis regions are photographed at a magnification of 5000× using a scanning electron microscope (product name: S-4800, Hitachi High-Technologies Corporation). Each of the obtained total of 9 photographed images is binarized using image processing software (product name: LUZEX, Nireco Corporation).

The binarization procedure is the same binarization procedure as in the determination of the interdomain distance Dm as described above. For each of the binarized images from the nine photographed images, the distance between the walls of the domains is determined and the arithmetic average value of these values is calculated. This value is designated Dms.

Measurement of the Surface Roughness Ra

The measurement is carried out using a surface roughness analyzer (product name: SE-3500, Kosaka Laboratory Ltd.) in accordance with the surface roughness standard JIS B 0601-1994. Ra is measured at six randomly selected locations on the surface of the conductive member and the arithmetic average value of these measurements is used. The cut-off value is 0.8 mm and the evaluation length is 8 mm.

Conductive Members 2 to 9 Production Example

Conductive members 2 to 9 were produced proceeding as for conductive member 1, but using the materials and conditions indicated in Table 7A-1 and Table 7A-2 with regard to the starting rubber, conducting agent, vulcanizing agent, and vulcanization accelerator.

The details for the materials indicated in Table 7A-1 and Table 7A-2 are given in Table 7B-1 for the rubber materials, Table 7B-2 for the conducting agents, and Table 7B-3 for the vulcanizing agents and vulcanization accelerators.

Comparative Conductive Member 1

A conductive member C1 was produced proceeding as in Example 1, but using the materials and conditions given in Table 7A-1 and Table 7A-2. A conductive resin layer was then also placed on conductive member C1 in accordance with the following method to produce comparative conductive member 1, and measurement and evaluation were carried out as in Example 1.

Methyl isobutyl ketone was added as solvent to the caprolactone-modified acrylic polyol solution to adjust the solids fraction to 10 mass %. A mixed solution was prepared using the materials indicated in the following Table 6 per 1000 parts (100 parts solid fraction) of this acrylic polyol solution. At this point, the mixture of blocked HDI and blocked IPDI gave "NCO/OH=1.0".

TABLE 6

| | Ingredient name | Amount of incorporation (parts) |
|---|---|---|
| Base | Caprolactone-modified acrylic polyol solution (solids fraction: 70 mass %) (product name: PLACCEL DC2016, Daicel Corporation) | 100 (solids fraction) |
| Curing agent 1 | Blocked isocyanate A (IPDI, solids fraction = 60 mass %) (product name: VESTANAT B1370, Degussa Japan Co., Ltd.) | 37 (solids fraction) |
| Curing agent 2 | Blocked isocyanate B (HDI, solids fraction = 80 mass %) (product name: DURANATE TPA-B80E, Asahi Kasei Chemicals Corporation) | 24 (solids fraction) |
| Conducting agent | Carbon black (HAF) (product name: Seast3, Tokai Carbon Co., Ltd.) | 15 |

TABLE 6-continued

| | Ingredient name | Amount of incorporation (parts) |
|---|---|---|
| Additive 1 | Acicular rutile titanium oxide fine particles (product name: MT-100T, TAYCA Corporation) | 35 |
| Additive 2 | Modified dimethylsilicone oil (product name: SH28PA Toray Dow Corning Silicone Corporation) | 0.1 |

210 g of the aforementioned mixed solution and 200 g of glass beads with an average particle diameter of 0.8 mm as media were then mixed in a 450-mL glass bottle, and a predispersion was performed for 24 hours using a paint shaker disperser to obtain a paint for forming a conductive resin layer.

Using its longitudinal direction for the vertical direction, the conductive member C1 was painted by a dipping procedure by immersion in the paint for forming a conductive resin layer. The immersion time for the dipping application was 9 seconds, the withdrawal speed was an initial speed of 20 mm/sec and a final speed of 2 mm/sec, and between these the speed was linearly varied with time.

The obtained coated article was air-dried for 30 minutes at normal temperature; then dried for 1 hour in a convection circulation dryer set to 90° C.; and subsequently dried for 1 hour in a convection circulation dryer set to 160° C. to obtain comparative conductive member 1.

Comparative Conductive Members 2 to 5 Production Example

Comparative conductive members 2 to 5 were produced proceeding as in Example 1, but using the materials and conditions indicated in Table 7A-1 and Table 7A-2, and the same measurements and evaluations as in Example 1 were performed.

Table 8 gives the properties of the produced conductive members 1 to 9 and comparative conductive members 1 to 5.

TABLE 7A-1

| | Domain-forming rubber mixture | | | | | | | | |
|---|---|---|---|---|---|---|---|---|---|
| | Rubber starting material | | | | Conductive agent | | | Dispersing time | |
| Conductive member No. | Domain material | Material abbreviation | SP value | Mooney viscosity | Type | Parts | DBP | MIN | Mooney viscosity |
| 1 | SBR | T1000 | 16.8 | 45 | #5500 | 60 | 155 | 30 | 84 |
| 2 | SBR | T1000 | 16.8 | 45 | #7360 | 45 | 87 | 30 | 65 |
| 3 | SBR | T1000 | 16.8 | 45 | #5500 | 60 | 155 | 20 | 92 |
| 4 | Butyl | JSR Butyl 065 | 15.8 | 32 | #5500 | 65 | 155 | 30 | 93 |
| 5 | NBR | DN401 | 17.4 | 32 | #7360 | 60 | 87 | 30 | 51 |
| 6 | NBR | N202S | 20.4 | 51 | #5500 | 80 | 155 | 30 | 105 |
| 7 | Butyl | JSR Butyl 065 | 15.8 | 32 | #5500 | 65 | 155 | 30 | 93 |
| 8 | SBR | T2100 | 17.0 | 78 | #5500 | 80 | 155 | 30 | 105 |
| 9 | NBR | N202S | 20.4 | 57 | #7360 | 60 | 87 | 30 | 85 |
| Comparative 1 | NBR | N230SV | 19.2 | 32 | LV | 3 | — | 30 | 35 |
| Comparative 2 | BR | JSR T0700 | 17.1 | 43 | #7360 | 80 | 87 | 30 | 85 |
| Comparative 3 | SBR | T2003 | 17.0 | 45 | — | — | — | — | 45 |
| Comparative 4 | SBR | T1000 | 16.8 | 45 | #5500 | 60 | 155 | 30 | 75 |
| Comparative 5 | Butyl | JSR Butyl 065 | 15.8 | 32 | KETJEN | 12 | 360 | 30 | 50 |

With regard to the Mooney viscosities in the table, the Mooney viscosity for the starting materials is the catalogue value from the particular manufacturer and the Mooney viscosity of the mixtures is the Mooney viscosity $ML_{(1+4)}$ measured at the rubber temperature during kneading. The unit for the SP value is $(J/cm^3)^{0.5}$, and DBP refers to the amount of DBP absorption ($cm^3$/100 g).

TABLE 7A-2

| | Matrix-forming rubber mixture | | | | | | | | | Unvulcanized rubber composition | | Unvulcanized rubber dispersion | | Sulfur vulcanizing agent | Vulcanization accelerator | |
|---|---|---|---|---|---|---|---|---|---|---|---|---|---|---|---|---|
| | Rubber starting material | | | | Conductive agent | | | | | | | | | | | |
| Conductive member No. | | Material | SP value | Mooney viscosity | Type | Parts | Mooney viscosity | Domain Parts | Matrix Parts | Rotation rate rpm | Kneading time min | Parts | name | Parts |
| 1 | Butyl | JSR Butyl 065 | 15.8 | 32 | — | — | 40 | 25 | 75 | 30 | 20 | 3 | TT | 3 |
| 2 | SBR | A303 | 17.0 | 46 | — | — | 52 | 15 | 85 | 30 | 20 | 3 | TT | 3 |

TABLE 7A-2-continued

| Conductive member No. | Matrix-forming rubber mixture: Rubber starting material: Material | | SP value | Mooney viscosity | Conductive agent: Type | Conductive agent: Parts | Mooney viscosity | Unvulcanized rubber composition: Domain Parts | Unvulcanized rubber composition: Matrix Parts | Unvulcanized rubber dispersion: Rotation rate rpm | Unvulcanized rubber dispersion: Kneading time min | Sulfur vulcanizing agent Parts | Vulcanization accelerator: name | Vulcanization accelerator: Parts |
|---|---|---|---|---|---|---|---|---|---|---|---|---|---|---|
| 3 | Butyl | JSR Butyl 065 | 15.8 | 32 | — | — | 40 | 23 | 77 | 30 | 16 | 3 | TT | 3 |
| 4 | SBR | T2003 | 17.0 | 33 | — | — | 52 | 24 | 76 | 30 | 20 | 2 | TT | 2 |
| 5 | Butyl | JSR Butyl 065 | 15.8 | 32 | — | — | 40 | 15 | 85 | 30 | 20 | 3 | TT | 3 |
| 6 | SBR | A303 | 17.0 | 46 | — | — | 78 | 15 | 85 | 30 | 20 | 7 | TT | 4 |
| 7 | BR | T0700 | 17.1 | 43 | — | — | 53 | 21 | 79 | 30 | 20 | 3 | TT | 3 |
| 8 | EPDM | Esplene301A | 17.0 | 44 | — | — | 58 | 15 | 85 | 30 | 20 | 3 | TET | 3 |
| 9 | EPDM | Esplene505A | 16.0 | 47 | — | — | 52 | 25 | 75 | 30 | 20 | 3 | TET | 3 |
| Comparative 1 | — | — | — | — | — | — | — | 100 | 0 | — | — | 3 | TBZTD | 1 |
| Comparative 2 | NBR | N230SV | 19.2 | 32 | — | — | 37 | 25 | 75 | 30 | 20 | 3 | TBZTD | 1 |
| Comparative 3 | NBR | N230SV | 19.2 | 32 | #7360 | 60 | 74 | 75 | 25 | 30 | 20 | 3 | TBZTD | 1 |
| Comparative 4 | NBR | N260S | 17.2 | 46 | — | — | 51 | 25 | 75 | 30 | 20 | 3 | TBZTD | 1 |
| Comparative 5 | EPDM | Esplene301A | 17.0 | 44 | — | — | 90 | 22 | 78 | 30 | 20 | 3 | TET | 3 |

With regard to the Mooney viscosities in the table, the Mooney viscosity for the starting materials is the catalogue value from the particular manufacturer and the Mooney viscosity of the mixtures is the Mooney viscosity $ML_{(1+4)}$ measured at the rubber temperature during kneading.

TABLE 7B-1

Rubber Materials

| Abbreviation for material | | Material name | Product name | Manufacturer |
|---|---|---|---|---|
| Butyl | Butyl065 | Butyl rubber | JSR Butyl 065 | JSR Corporation |
| BR | T0700 | Polybutadiene rubber | JSR T0700 | JSR Corporation |
| ECO | CG103 | Epichlorohydrin rubber | EPICHLOMER CG103 | Osaka Soda Co., Ltd. |
| EPDM | Esplene301A | Ethylene-propylene-diene rubber | Esprene 301A | Sumitomo Chemical Co., Ltd. |
| EPDM | Esplene505A | Ethylene-propylene-diene rubber | Esprene 505A | Sumitomo Chemical Co., Ltd. |
| NBR | DN401LL | Acrylonitrile-butadiene rubber | Nipol DN401LL | ZEON Corporation |
| NBR | N230SV | Acrylonitrile-butadiene rubber | NBR N230SV | JSR Corporation |
| NBR | N230S | Acrylonitrile-butadiene rubber | NBR N230S | JSR Corporation |
| NBR | N202S | Acrylonitrile-butadiene rubber | NBR N202S | JSR Corporation |
| SBR | T2003 | Styrene-butadiene rubber | TUFDENE 2003 | Asahi Kasei Corporation |
| SBR | T1000 | Styrene-butadiene rubber | TUFDENE 1000 | Asahi Kasei Corporation |
| SBR | T2100 | Styrene-butadiene rubber | TUFDENE 2100 | Asahi Kasei Corporation |
| SBR | A303 | Styrene-butadiene rubber | ASAPREN 303 | Asahi Kasei Corporation |

TABLE 7B-2

Conductive Agents

| Abbreviation for material | Material name | Product name | Manufacturer |
|---|---|---|---|
| #7360 | Conductive carbon black | TOKABLACK #7360SB | Tokai Carbon Co., Ltd. |
| #5500 | Conductive carbon black | TOKABLACK #5500 | Tokai Carbon Co., Ltd. |
| KETJEN | Conductive carbon black | Carbon ECP | Lion Specialty Chemicals Co., Ltd. |
| LV | Ionic conducting agent | LV70 | ADEKA |

TABLE 7B-3

Vulcanizing Agents and Vulcanization Accelerators

| Abbreviation for material | Material name | Product name | Manufacturer |
|---|---|---|---|
| Sulfur | Sulfur | SULFAX PMC | Tsurumi Chemical Industry Co., Ltd. |
| TT | Tetramethylthiuram disulfide | NOCCELER TT-P | Ouchi Shinko Chemical Industrial Co., Ltd. |
| TBZTD | Tetrabenzylthiuram disulfide | Sanceler TBZTD | Sanshin Chemical Industry Co., Ltd. |
| TET | Tetraethylthiuram disulfide | Sanceler TET-G | Sanshin Chemical Industry Co., Ltd. |

TABLE 8

| Conductive member No. | MD structure | Ra μm | R1 Ωcm | R2 Ωcm | R1/R2 Times | G1 N/mm² | G2 N/mm² | Relationship between G1 and G2 — | Dms μm | Dm μm | σm/Dm — | Domain diameter D μm | Domain diameter Ds μm | σd/D — |
|---|---|---|---|---|---|---|---|---|---|---|---|---|---|---|
| 1 | Present | 0.85 | 5.83E+16 | 1.66E+01 | 3.5.E+15 | 1.9 | 2.3 | G1 < G2 | 0.25 | 0.22 | 0.24 | 0.20 | 0.20 | 0.25 |
| 2 | Present | 2.00 | 2.11E+12 | 2.60E+05 | 8.1.E+06 | 3.4 | 4.2 | G1 < G2 | 0.47 | 0.44 | 0.26 | 0.44 | 0.44 | 0.26 |
| 3 | Present | 0.95 | 5.09E+16 | 1.26E+01 | 4.0.E+15 | 3.7 | 4.4 | G1 < G2 | 0.88 | 0.85 | 0.25 | 0.51 | 0.51 | 0.22 |
| 4 | Present | 0.82 | 2.62E+12 | 6.23E+01 | 4.2.E+10 | 3.7 | 4.4 | G1 < G2 | 1.33 | 1.22 | 0.22 | 1.20 | 1.20 | 0.24 |
| 5 | Present | 0.86 | 6.90E+16 | 4.80E+03 | 1.4.E+13 | 1.7 | 2.1 | G1 < G2 | 0.37 | 0.35 | 0.25 | 0.38 | 0.38 | 0.25 |
| 6 | Present | 0.84 | 3.50E+12 | 4.10E+01 | 8.5.E+10 | 9.1 | 10.5 | G1 < G2 | 1.27 | 1.24 | 0.37 | 1.21 | 1.21 | 0.26 |
| 7 | Present | 0.82 | 7.00E+15 | 2.17E+01 | 3.2.E+14 | 2.7 | 3.6 | G1 < G2 | 1.23 | 1.12 | 0.23 | 1.12 | 1.12 | 0.22 |
| 8 | Present | 0.80 | 2.95E+15 | 1.03E+01 | 2.9.E+14 | 4.7 | 5.5 | G1 < G2 | 0.31 | 0.29 | 0.26 | 0.31 | 0.31 | 0.25 |
| 9 | Present | 0.86 | 6.27E+15 | 5.76E+01 | 1.1.E+14 | 2.7 | 3.2 | G1 < G2 | 0.58 | 0.56 | 0.26 | 0.48 | 0.48 | 0.26 |
| Comparative 1 | Absent | 0.92 | — | — | — | — | — | — | — | — | — | — | — | — |
| Comparative 2 | Present | 0.83 | 2.58E+09 | 5.20E+01 | 5.0.E+07 | 2.2 | 2.7 | G1 < G2 | 0.32 | 0.23 | 0.26 | 2.30 | 2.30 | 0.21 |
| Comparative 3 | Present | 0.83 | 9.20E+02 | 2.60E+15 | 3.5.E−13 | 2.6 | 2.1 | G1 > G2 | 3.10 | 2.20 | 0.41 | 2.50 | 2.50 | 0.47 |
| Comparative 4 | Present | 0.85 | 9.80E+10 | 1.10E+03 | 8.9.E+07 | 1.9 | 2.3 | G1 < G2 | 0.34 | 0.24 | 0.25 | 0.34 | 0.34 | 0.24 |
| Comparative 5 | Present | 2.10 | 6.42E+15 | 2.10E+02 | 3.1.E+13 | 1.9 | 2.3 | G1 < G2 | 0.88 | 0.84 | 0.56 | 2.10 | 2.10 | 0.55 |

In the table, for example, "5.83E+16" indicates "$5.83\times 10^{16}$". The "MD structure" refers to the presence/absence of a matrix-domain structure.

Example 1

An HP LaserJet Enterprise M609dn (HP Inc.) was prepared as the electrophotographic apparatus. The electrophotographic apparatus, conductive member 1, and process cartridge, which was provided by filling toner 1 into a prescribed cartridge, were then held for 48 hours in a low-temperature, low-humidity environment (15° C./10% RH) for the purpose of conditioning to the measurement environment.

The conductive member 1 that had been held in the indicated environment was installed as the charging roller of the aforementioned process cartridge, and the evaluations were carried out with this assembled in the M609dn.

This electrophotographic apparatus+process cartridge combination corresponds to the structure given in FIG. 5.

Anticipating the additional increases in speed and service life for printers in the future, the M609dn was used with its process speed modified to 400 mm/s. A4 color laser copy paper (80 g/m², Canon, Inc.) was used as the evaluation paper.

Image Evaluation

Using 2 prints/1 job of a horizontal line pattern having a print percentage of 1%, a test was run in which a total of 100000 prints were output in a mode where the machine was set to temporarily stop between jobs and after this to then start the next job.

The appearance of problems with the image was evaluated using the level of white spot image defects on a solid black image output as the 50000th print and the 100000th print. The specific evaluation criteria are given below. The ranks of A, B, and C were regarded as passing.

Evaluation Criteria

A: White spot image defects are not observed.

B: Fewer than 5 white spot image defects are produced.

C: At least 5, but fewer than 10 white spot image defects are produced.

D: At least 10 white spot image defects are produced.

Evaluation of Scratching of the Photosensitive Drum Dr

Scratching of the surface of the photosensitive member was checked using a loupe when the output of the 50000th print and the 100000th print in the aforementioned image output test in the 15° C./10% RH environment. The evaluation criteria are given below. The ranks of A, B, and C were regarded as passing.

Evaluation Criteria

A: Scratching of the surface of the photosensitive drum is completely absent.

B: Fine scratching with a width of less than 1.0 μm is present on the surface of the photosensitive drum.

C: Scratching with a width of at least 1.0 μm but less than 5.0 μm is present on the surface of the photosensitive drum.

D: Scratching with a width of at least 5.0 μm is present on the surface of the photosensitive drum.

The results of the evaluations are given in Table 9.

Examples 2 to 15 and Comparative Examples 1 to 7

The evaluations were performed proceeding as in Example 1, but changing the conductive member and toner fill as shown in Table 9. The results of the evaluations are given in Table 9.

TABLE 9

| | Constitution | | | Low-temperature, low-humidity environment | | |
|---|---|---|---|---|---|---|
| Example No. | Toner | Fine particle | Charging member | Number of prints at the evaluation [prints] | White spots Rank | Dr scratching Rank |
| 1 | Toner 1 | Fine particle 1 | Charging member 1 | 50000 | A | A |
| | | | | 100000 | A | A |
| 2 | Toner 1 | Fine particle 1 | Charging member 2 | 50000 | B | A |
| | | | | 100000 | B | A |

TABLE 9-continued

| | Constitution | | | Low-temperature, low-humidity environment | | |
|---|---|---|---|---|---|---|
| Example No. | Toner | Fine particle | Charging member | Number of prints at the evaluation [prints] | White spots Rank | Dr scratching Rank |
| 3 | Toner 1 | Fine particle 1 | Charging | 50000 | A | A |
| | | | member 3 | 100000 | B | A |
| 4 | Toner 1 | Fine particle 1 | Charging | 50000 | A | A |
| | | | member 4 | 100000 | B | A |
| 5 | Toner 2 | Fine particle 2 | Charging | 50000 | B | A |
| | | | member 1 | 100000 | B | A |
| 6 | Toner 3 | Fine particle 3 | Charging | 50000 | B | A |
| | | | member 1 | 100000 | B | A |
| 7 | Toner 1 | Fine particle 1 | Charging | 50000 | A | A |
| | | | member 5 | 100000 | B | A |
| 8 | Toner 1 | Fine particle 1 | Charging | 50000 | A | A |
| | | | member 6 | 100000 | A | B |
| 9 | Toner 4 | Fine particle 4 | Charging | 50000 | B | A |
| | | | member 4 | 100000 | C | A |
| 10 | Toner 1 | Fine particle 1 | Charging | 50000 | B | A |
| | | | member 7 | 100000 | B | A |
| 11 | Toner 5 | Fine particle 5 | Charging | 50000 | A | B |
| | | | member 1 | 100000 | A | C |
| 12 | Toner 6 | Fine particle 6 | Charging | 50000 | A | B |
| | | | member 1 | 100000 | A | B |
| 13 | Toner 7 | Fine particle 7 | Charging | 50000 | A | B |
| | | | member 1 | 100000 | A | B |
| 14 | Toner 8 | Fine particle 8 | Charging | 50000 | A | B |
| | | | member 1 | 100000 | A | C |
| 15 | Toner 9 | Sol-gel silica | Charging | 50000 | B | C |
| | | | member 1 | 100000 | B | C |
| Comparative | Toner 1 | Fine particle 1 | Comparative | 50000 | D | D |
| Example 1 | | | member 1 | 100000 | D | D |
| Comparative | Toner 1 | Fine particle 1 | Comparative | 50000 | C | D |
| Example 2 | | | member 2 | 100000 | C | D |
| Comparative | Toner 1 | Fine particle 1 | Comparative | 50000 | D | A |
| Example 3 | | | member 3 | 100000 | D | A |
| Comparative | Toner 1 | Fine particle 1 | Comparative | 50000 | B | A |
| Example 4 | | | member 4 | 100000 | D | A |
| Comparative | Toner 1 | Fine particle 1 | Comparative | 50000 | B | A |
| Example 5 | | | member 5 | 100000 | D | A |
| Comparative | Comparative | Fine particle 9 | Charging | 50000 | C | C |
| Example 6 | toner 1 | | member 1 | 100000 | D | C |
| Comparative | Toner 4 | Fine particle 4 | Charging | 50000 | D | B |
| Example 7 | | | member 1 | 100000 | D | B |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-191586, filed Oct. 18, 2019, which is hereby incorporated by reference herein in its entirety.

What is claimed is:

1. An electrophotographic apparatus comprising:

an electrophotographic photosensitive member, a charging unit for charging a surface of the electrophotographic photosensitive member, and a developing unit for developing an electrostatic latent image formed on the surface of the electrophotographic photosensitive member with a toner to form a toner image on the surface of the electrophotographic photosensitive member, wherein the charging unit comprises a conductive member disposed to be contactable with the electrophotographic photosensitive member;

the conductive member comprises:

a support having a conductive outer surface, and a conductive layer disposed on this outer surface of the support;

the conductive layer comprises:

a matrix, and a plurality of domains dispersed in the matrix;

the matrix contains a first rubber;

each of the domains contains a second rubber and an electronic conductive agent;

at least some of the domains are exposed at an outer surface of the conductive member;

the outer surface of the conductive member is constituted of at least the matrix and the domains that are exposed at the outer surface of the conductive member;

the matrix has a volume resistivity R1 of larger than $1.00\times10^{12}$ Ω·cm;

a volume resistivity R2 of the domains is smaller than the volume resistivity R1 of the matrix;

when G1 is Martens hardness in $N/mm^2$ measured on the matrix that is exposed at the outer surface of the conductive member and G2 is Martens hardness in $N/mm^2$ measured on the domains that are exposed at the outer surface of the conductive member, relationship $G1<G2$ is satisfied;

the outer surface of the conductive member has a surface roughness $R^a$ of not more than 2.00 μm;

the developing unit comprises the toner;

the toner comprises:

a toner particle containing a binder resin, and an external additive externally added to the toner particle;

the external additive has primary particle having a shape factor SF-1 of not more than 115; and when A is a number-average diameter of the primary particles of the external additive and Dms is an arithmetic average value of a distance between adjacent walls between the domains in the conductive layer in observation of the outer surface of the conductive member, A<Dms is satisfied.

2. The electrophotographic apparatus according to claim 1, wherein the G1 and the G2 are both in a range from 1.0 $N/mm^2$ to 10.0 $N/mm^2$.

3. The electrophotographic apparatus according to claim 1, wherein the primary particles of the external additive have number-average particle diameter A of 30 to 200 nm.

4. The electrophotographic apparatus according to claim 1, wherein the Dms is 0.15 to 2.00 μm.

5. The electrophotographic apparatus according to claim 1, wherein, in observation of a cross section of the conductive member, an arithmetic average value Dm of a distance between adjacent walls of the domains in the conductive layer is 0.15 to 2.00 μm.

6. The electrophotographic apparatus according to claim 1, wherein the external additive has indentation hardness at a load of 2 μN of 0.10 to 1.50 GPa.

7. The electrophotographic apparatus according to claim 1, wherein the external additive comprises organosilicon polymer fine particles.

8. The electrophotographic apparatus according to claim 1, wherein the external additive comprises polyalkylsilsesquioxane fine particles.

9. A process cartridge detachably provided to a main body of an electrophotographic apparatus, wherein the process cartridge comprises a charging unit for charging a surface of an electrophotographic photosensitive member, and a developing unit for developing an electrostatic latent image formed on the surface of the electrophotographic photosensitive member with a toner to form a toner image on the surface of the electrophotographic photosensitive member;

the charging unit comprises a conductive member disposed to be contactable with the electrophotographic photosensitive member;

the conductive member comprises:

a support having a conductive outer surface, and a conductive layer disposed on this outer surface of the support;

the conductive layer comprises:

a matrix, and a plurality of domains dispersed in the matrix;

the matrix contains a first rubber;

each of the domains contains a second rubber and an electronic conductive agent;

at least some of the domains are exposed at the outer surface of the conductive member;

the outer surface of the conductive member is constituted of at least the matrix and the domains that are exposed at the outer surface of the conductive member;

the matrix has a volume resistivity R1 of larger than $1.00\times10^{12}$ Ω·cm;

a volume resistivity R2 of the domains is smaller than the volume resistivity R1 of the matrix;

when G1 is Martens hardness in $N/mm^2$ measured on the matrix that is exposed at the outer surface of the conductive member and G2 is Martens hardness in $N/mm^2$ measured on the domains that are exposed at the outer surface of the conductive member, relationship G1<G2 is satisfied;

the outer surface of the conductive member has a surface roughness $R^a$ of not more than 2.00 μm;

the developing unit comprises the toner;

the toner comprises:

a toner particle containing a binder resin, and an external additive externally added to the toner particle;

the external additive has primary particle having a shape factor SF-1 of not more than 115; and when A is a number-average diameter of the primary particles of the external additive and Dms is an arithmetic average value of a distance between adjacent walls between the domains in the conductive layer in observation of the outer surface of the conductive member, A<Dms is satisfied.

10. A cartridge set comprising a first cartridge and a second cartridge detachably provided to a main body of an electrophotographic apparatus, wherein the first cartridge comprises a charging unit for charging a surface of an electrophotographic photosensitive member and has a first frame for supporting the charging unit;

the second cartridge comprises a toner container that holds a toner for forming a toner image on the surface of the electrophotographic photosensitive member by developing an electrostatic latent image formed on the surface of the electrophotographic photosensitive member;

the charging unit comprises a conductive member disposed to be contactable with the electrophotographic photosensitive member;

the conductive member comprises:

a support having a conductive outer surface, and a conductive layer disposed on this outer surface of the support;

the conductive layer comprises:

a matrix, and a plurality of domains dispersed in the matrix;

the matrix contains a first rubber;

each of the domains contains a second rubber and an electronic conductive agent;

at least some of the domains are exposed at the outer surface of the conductive member;

the outer surface of the conductive member is constituted of at least the matrix and the domains that are exposed at the outer surface of the conductive member;

the matrix has a volume resistivity R1 of larger than $1.00\times10^{12}$ Ω·cm;

a volume resistivity R2 of the domains is smaller than the volume resistivity R1 of the matrix;

when G1 is Martens hardness in $N/mm^2$ measured on the matrix that is exposed at the outer surface of the conductive member and G2 is Martens hardness in $N/mm^2$ measured on the domains that are exposed at the outer surface of the conductive member, relationship G1<G2 is satisfied;

the outer surface of the conductive member has a surface roughness $R^a$ of not more than 2.00 μm;

the toner comprises:

a toner particle containing a binder resin, and an external additive externally added to the toner particle;

the external additive has primary particle having a shape factor SF-1 of not more than 115; and when A is a number-average diameter of the primary particles of the external additive and Dms is an arithmetic average value of a distance between adjacent walls between the domains in the conductive layer in observation of the outer surface of the conductive member, A<Dms is satisfied.

* * * * *